US006565814B1

(12) United States Patent
Anraku et al.

(10) Patent No.: US 6,565,814 B1
(45) Date of Patent: May 20, 2003

(54) CLOSURE STRUCTURE FOR VACUUM SPECIMEN COLLECTION CONTAINER, VACUUM SPECIMEN COLLECTION CONTAINER, VACUUM SPECIMEN COLLECTION SYSTEM, HOLDER FOR VACUUM SPECIMEN COLLECTION SYSTEM AND THERMOPLASTIC ELASTOMER COMPOSITION FOR FORMING CLOSURE STRUCTURE

(75) Inventors: Hideo Anraku, Shinnanyo (JP); Ryusuke Okamoto, Shinnanyo (JP)

(73) Assignee: Sekisui Chemical Co., Ltd., Osaka (JP)

( * ) Notice: Subject to any disclaimer, the term of this patent is extended or adjusted under 35 U.S.C. 154(b) by 0 days.

(21) Appl. No.: 09/622,891

(22) PCT Filed: Mar. 10, 1999

(86) PCT No.: PCT/JP99/01176

§ 371 (c)(1),
(2), (4) Date: Aug. 30, 2000

(87) PCT Pub. No.: WO99/47043

PCT Pub. Date: Sep. 23, 1999

(30) Foreign Application Priority Data

Mar. 18, 1998 (JP) ..... 10-068825

(51) Int. Cl.[7] ..... B01L 3/00
(52) U.S. Cl. ..... 422/102; 422/99
(58) Field of Search ..... 422/58, 44, 68.1, 422/99, 102; 436/16

(56) References Cited

U.S. PATENT DOCUMENTS 3,881,626 A * 5/1975 Bartell ..... 215/256
4,089,432 A * 5/1978 Crankshaw et al. ..... 215/6
4,134,512 A * 1/1979 Nugent ..... 215/247
4,193,402 A * 3/1980 Rumpler ..... 128/272

(List continued on next page.)

FOREIGN PATENT DOCUMENTS

EP 0 454 493 A2 * 10/1991
JP 7-51253 * 2/1995

OTHER PUBLICATIONS

Geankoplis, Christie J. Transport Processes and Unit Operations. Englewood Cliffs, NJ: Prentice Hall P T R, 1993.*
Shackelford, James F. Introduction to Materials Science for Engineers. New York, NY: Macmillan Publishing Company, 1992.*

*Primary Examiner*—Arlen Soderquist
*Assistant Examiner*—Elizabeth Quan
(74) *Attorney, Agent, or Firm*—Townsend & Banta

(57) ABSTRACT

A closure structure is provided for a vacuum specimen collection container which can maintain a vacuum pressure within the specimen collection tube and which includes a needle cannula penetrating portion having needle hole sealability. The closure structure can be detachably fitted in an open end of a specimen collection container in an airtight manner to maintain a vacuum condition within the specimen collection container. The closure structure includes a grip section, a rubber elastic needle cannula penetrating portion disposed to fill up a through-hole in a grip section and a rubber elastic fitting portion configured to follow an interior surface profile of an open end of a specimen collection container, thereby to fit therein in a airtight fashion. The grip section has a higher rigidity relative to the needle cannula penetrating portion and the fitting portion. A tubular side wall of a grip section has on its inner side at least one raised portion or recessed portion to prevent kickback.

23 Claims, 14 Drawing Sheets

U.S. PATENT DOCUMENTS 4,205,754 A * 6/1980 Nielsen et al. ..... 215/249
4,227,620 A * 10/1980 Conway ..... 215/232
4,254,884 A * 3/1981 Maruyama ..... 215/232
4,278,437 A * 7/1981 Haggar ..... 23/230 B
4,308,232 A * 12/1981 Crouther et al. ..... 422/102
4,402,911 A * 9/1983 Walters ..... 422/102
4,652,429 A * 3/1987 Konrad ..... 422/102
4,664,274 A * 5/1987 Konrad ..... 215/232
4,675,159 A * 6/1987 Al-Sioufi ..... 422/36
4,830,217 A * 5/1989 Dufresne et al. ..... 220/420
4,883,641 A * 11/1989 Wicks et al. ..... 422/50
5,326,534 A * 7/1994 Yamazaki et al. ..... 422/102
5,360,012 A * 11/1994 Ebara et al. ..... 128/764
5,370,252 A * 12/1994 Parsons et al. ..... 215/247
5,514,339 A * 5/1996 Leopardi et al. ..... 422/99
5,545,375 A * 8/1996 Tropsha et al. ..... 422/102
5,556,599 A * 9/1996 Ahmed ..... 422/102
5,738,233 A * 4/1998 Burns ..... 215/247

* cited by examiner

CLOSURE STRUCTURE FOR VACUUM SPECIMEN COLLECTION CONTAINER, VACUUM SPECIMEN COLLECTION CONTAINER, VACUUM SPECIMEN COLLECTION SYSTEM, HOLDER FOR VACUUM SPECIMEN COLLECTION SYSTEM AND THERMOPLASTIC ELASTOMER COMPOSITION FOR FORMING CLOSURE STRUCTURE

TECHNICAL FIELD

The present invention relates to a closure structure for a vacuum specimen collection container, a vacuum specimen collection container incorporating the closure structure, a vacuum specimen collection system and a holder for a vacuum specimen collection device, which are employed in conducting analytical tests of liquid specimens such as blood and urine or gaseous specimens such as expired gas and working atmosphere, and further to a thermoplastic elastomer composition for forming the closure structure.

BACKGROUND ART

A typical specimen collected by vacuum specimen collection systems is blood. Accordingly, a vacuum blood collection container, as illustrative of vacuum specimen collection containers, is explained below.

A typical conventional vacuum blood collection system is disclosed in Japanese Patent Laying-open No. 62-227316 (1987). FIG. 18 illustrates a basic construction of such a conventional vacuum blood collection system. FIG. 18(*a*) shows a vacuum blood collection tube 30 including a blood collection tube 32 sealed at its open end by attachment of a closure structure 31 having good needle hole sealability and gas barrier properties. FIG. 18(*b*) shows a holder 33 for vacuum blood collection device, into which the vacuum blood collection tube 30 can be inserted. The holder 33 has a blood collection needle retaining bore 34 at its one end. The blood collection needle retaining bore 34 carries an internal thread. FIG. 18(*c*) shows a vacuum blood collection needle 35 which includes a hub 36 having an external thread and needle tips 37, 38 positioned on opposite sides of the hub. The external thread on the hub 36 is configured to screw into the internal thread on the blood collection needle retaining bore 34 of the holder 33 shown in FIG. 18(*b*).

FIG. 20 is a perspective view, showing the vacuum blood collection system of FIG. 18 while in use for blood collection. When in use for blood collection, the vacuum blood collection needle 35 is screwed into the blood collection needle retaining bore 34. Then, the vacuum blood collection container 30 is inserted in the holder 33 such that the needle tip 37 of the blood collection needle 35 is forced to penetrate the closure structure 31 to a depth of less than its thickness, whereby the needle tip 37 is kept sealed. This is to prevent the blood from leaking through the needle tip 37 when the needle tip 38 is inserted in a blood vessel.

As shown in FIG. 20, an operator holds a whole assembly of blood collection needle 35, holder 33 and blood collection container 30 in an slanted orientation along an axial direction of blood vessel of a subject and then inserts the exposed needle tip 38 in the blood vessel. When the blood collection container 30 is pushed further inside the holder 33, the needle tip 37 is forced to penetrate through the closure structure 31 and the pressure differential between the blood collection container side and the blood vessel side causes the blood to flow into the blood collection container 30. When the pressure differential decreases to zero, the blood ceases to flow. Then, the whole assembly is drawn from the blood vessel to end the blood collection procedure.

The above-described blood collection needle 35 is a so-called single blood collection needle for use in introducing blood into a single vacuum blood collection container. In distributing blood into plural vacuum blood collection containers, the needle tip must be kept in a position within the blood vessel while one blood collection container is replaced by another. Such use of single blood collection needle possibly leads to the leakage of blood from the needle tip 37. Accordingly, a multiple blood collection needle 39 as shown in FIG. 19 has come into use. The multiple blood collection needle 39 has an elastic sheath 40 which encloses the needle tip 37 for insertion into the closure structure in an airtight manner to prevent blood leakage therefrom. Where such a multiple blood collection needle 39 is used, the blood collection needle 39 assembled to the holder 33 is operated to penetrate in the blood vessel. Subsequently, the blood collection container 30 is assembled to the holder 33 so that it is brought into communication with the blood vessel. This results in collecting the blood in the blood collection container 30.

Key qualities sought for elastic materials used to form the closure structure 31 as shown in FIG. 18(*a*) include gas barrier properties sufficient to maintain a vacuum pressure within the blood collection container and the ability to seal a needle hole left after the needle tip has been retracted. This has led to the widespread use of crosslinked isobutylene-isoprene rubbers (crosslinked IIR, crosslinked butyl rubber).

The closure structure 31 shown in FIG. 18(*a*) has a configuration most widely adopted in the art. Subsequent to collection of blood, the closure structure 31 is detached to dispense the blood from the blood collection container 30. It has been reported, however, that the blood is likely caused to splash the moment the closure structure 31 is detached. This is attributed to the configuration of closure structure adopted to provide the improved seal for better maintaining the interior vacuum pressure of the blood collection container 30. In order to obviate such problems, the use of composite structural closures incorporating a cover disposed to cover a crosslinked butyl rubber closure and prevent splashing of blood has been proposed, for example, by Japanese Patent Laying-Open Nos. Hei 5-168611, Hei 4-215961, Sho 59-228831, Sho 60-242367, Sho 61-170437, Sho 59-230539 and Hei 3-505320.

As stated above, crosslinked butyl rubber has been widely used in the manufacture of closure structures. The use of such crosslinked butyl rubber is however reported to accompany problems, such as the requirements to undergo a prolonged vulcanizing period and subject to washing with water to remove elutable contents thereof, resulting in the reduced productivity.

The crosslinked butyl rubber, because of its inability to be chemically or thermally adhered to a cover member, is physically assembled with the cover member. Such a built-in construction however suffers from a problem of easy separation of the closure structure. For the purpose of preventing such separation, a construction has been proposed which utilizes a generally double-walled tubular cover member having an inner tubular portion fittingly embedded into the crosslinked butyl rubber member. However, the excellent sealing performance of the crosslinked butyl rubber closure structure relies not only upon the properties intrinsic to the material but also upon the pressure that is exerted on the closure structure when it is fitted in a blood collection tube and acts to close a hole pierced by a needle. Accordingly, the use of the generally double-walled tubular cover member may result in the reduced needle hole sealability.

Japanese Patent Laying-Open No. Sho 57-59536 proposes a closure structure wherein a superior gas barrier film is adhered to or embedded in an inferior gas barrier closure body formed of thermoplastic elastomer. The requirement to add an adhering or embedding process, however, results in sacrificing the high productivity that is a key advantage obtained with the use of thermoplastic elastomer.

Closure structures which can be injection molded in a highly productive fashion are disclosed, for example, in Japanese Patent Laying-Open Nos. Sho 58-58057, Sho 61-64253 and Sho 59-28965. These references describe the use of thermoplastic resins and elastomers, as injection moldable materials, which incorporate uncrosslinked butyl rubbers or flake-form inorganic fillers to assure increased elasticity and gas barrier properties. However, the loading of such additives results in the reduced needle hole sealability, which necessitates incorporation of another thermoplastic elastomer member into a needle cannula pierceable site, and also to the increased resistance to needle penetration.

In Japanese Patent Laying-Open Nos. Hei 4-279152 and Hei 7-51253, a composite structure is proposed. Injection moldable materials, such as thermoplastic elastomer, are used for the needle-pierceable elastic member. The above-described cover for blocking the blood splash is further provided to cover a closure structure. However, no explicit disclosure is not provided as to the improvement in gas barrier properties of thermoplastic elastomers. Simply following a conventional measure, a separate gas barrier sheet is additionally disposed on an upper face of the cover.

In Japanese Patent Laying-Open Nos. Sho 57-154057, Hei 1-76831 and Hei 2-174835 and Utility Model Laying-Open No. Sho 62-160908, sheet-form closures distinct in configuration from typical rubber closures are proposed. A layered sheet such as consisting of an aluminum foil and a needle hole-sealable rubber sheet or rubber tip is directly joined to an open end of a blood collection container by an adhesive or fusion bonding.

This new type of sheet-form closure is reported to have a superior gas barrier property because of its incorporation of a gas impermeable material such as an aluminum foil. It is also reported to exhibit an extremely low resistance to penetration of a blood collection needle, leading to the marked reduction of blood collecting operation load. The high productivity also results. However, the closure once removed from the open end of the blood collection container can not be rejoined thereto. This necessitates separate preparation of a detachable stopper which, when attached, allows storage of specimen in the blood collection container.

Japanese Patent Laying-Open No. Hei 3-97450 proposes a closure formed from injection moldable thermoplastic resins. The closure has an axially-extending communicating hole that permits a needle cannula to pass therethrough. The hole is filled with a needle-pierceable elastic sealing member. Alternatively, a laminated sealing member consisting of an aluminum foil and a vulcanized rubber sheet is brought into close contact with the hole. The closure is coupled to the blood collection container not by elastic fit commonly adapted for conventional closure structures but by rigid fit between rigid thermoplastic resins. This is reported as being based on the following reason: When the rubber elastic closure is detached from the blood collection tube filled with blood and then reattached, its superior sealability serves such that an air inside the blood collection tube is prevented from escaping therefrom and is compressed to increase its pressure. The counterforce that the increased pressure exerts against the closure tends to push the closure off the blood collection tube. The use of rigid fit obviates this disadvantage.

The reference describes the rigid fit as being also effective in maintaining an internal vacuum pressure of the blood collection tube. However, molding of thermoplastic resins is often accompanied by defects that disturb close contact of the closure with an inside wall of the blood collection tube or by deformation based on residual strain. Accordingly, the rigid fit used to couple the closure to the blood collection tube presents a problem from an aspect of quality control.

Even in cases where any of the above-described closures is used in combination with the multiple blood collection needle 39 to collect blood, the blood collection container is subjected to a counterforce that the elastic sheath 40 disposed to cover the closure penetrating tip of the blood collection needle exerts when it is compressed. A kickback phenomenon which repels the vacuum blood collection tube from the vacuum blood collection device holder 33 is then likely caused to occur.

In order to prevent the kickback phenomenon, it is required to increase sliding friction resistance either between an outer surface of the closure-penetrating needle cannula 37 and a needle penetrating portion of the closure or between an inner wall surface of the holder and an outer surface of the vacuum blood collection tube. However, the former leads inevitably to the increased resistance to needle penetration. For the latter, it becomes necessary to increase sliding friction resistance or engagement retention between the holder and the blood collection tube or between the holder and the outer surface of the closure, as by providing a ridge or a spring-like elastic tongue on an inner wall surface of the holder or providing a fixed or movable hooking mechanism. However, in either case, the increased resistance results when the blood collection tube is inserted in and pulled out from the holder. This obliges an operator to put the increased strength into its finger tip in a forced posture, leading to the increased tendency for the needle tip to move in the blood vessel. As a result, a heavier burden is imposed on both the operator and subject.

Even in the case where the friction resistance or engagement retention between the holder inner wall surface and the blood collection tube outer surface is increased, outer surface portions of the blood collection tubes or the closures must be uniformly expanded to diameters which permit slide or engagement thereof with an inner surface of the holder, since one blood collection device holder is usually designed to accommodate various sizes of blood collection tubes and closures. Small-volume blood collection tubes having sizes of about 4–7 ml have small diameter tubular bodies. Usually, a test tube rack designed to hold such blood collection tubes define spaces sized for accommodating the tubular bodies at small distances. Accordingly, the attempt to accommodate the blood collection tubes locally increased in diameter as described above laterally in a row within such a test tube rack fails since the larger diameter portions of those blood collection tubes interfere with each other. This has actually obliged the use of a larger test tube lack designed to accommodate 10 ml tubes, which provides a loose hold to the blood collection tubes and imposes marked inconveniences.

There accordingly remains a need for closure structure for vacuum blood collection container, which can enjoy high productivity and maintain a vacuum pressure within the blood collection tube and which is excellent in needle cannula-pierceable property, needle hole sealability and kickback preventing property.

DISCLOSURE OF THE INVENTION

An object of the present invention is to provide a detachable closure structure for vacuum specimen collection container, which can enjoy high productivity and maintain a vacuum pressure within the blood collection tube and which is excellent in needle cannula-pierceable property, needle hole sealability and kickback preventing property; a vacuum specimen collection container incorporating the closure structure; vacuum specimen collection device holder and a thermoplastic elastomer composition for formation of the closure structure.

A closure structure for a vacuum specimen collection container, in accordance with a first invention of the present invention is constructed such that it can be detachably fitted in an open end of a specimen collection tube in an airtight manner to maintain a vacuum condition inside the specimen collection tube. Characteristically, it includes a grip section having a tubular side wall portion for providing a finger grip, a partition portion extending inward from the side wall portion and a through-hole through which a specimen collection needle cannula can be passed into the specimen collection tube; a rubber-like elastic needle cannula penetrating portion provided to fill up the through-hole in the grip section and having the capability to be pierced by a needle cannula and reseal a hole if left after the needle cannula is retracted; and a rubber-like elastic fitting portion extending downward from a peripheral edge portion of the rubber-like elastic needle cannula penetrating portion and configured to follow an inner surface profile at the open end of the specimen collection tube so that it can contact fit therein in an airtight fashion. The grip section has a higher rigidity relative to the needle cannula penetrating portion and the fitting portion. Also, the tubular side wall of the grip section is provided on its inner side with at least one raised or recessed portion for kickback preventive purpose.

In a particular aspect of the present invention, the closure structure for a vacuum specimen collection container further includes a fitting portion supporting member which extends from the partition portion toward the fitting portion and is embedded in the fitting portion. This fitting portion supporting member has a lower edge located below a bottom surface of the needle cannula penetrating portion on which a protuberance is provided.

A closure structure for a vacuum specimen collection container, in accordance with a second invention of the present invention, is constructed such that it can be detachably fitted in an open end of a specimen collection tube in an airtight manner to maintain a vacuum condition inside the specimen collection tube. Characteristically, it includes a grip section having a tubular side wall portion for providing a finger grip, a partition portion extending inward from the side wall portion and a through-hole through which a specimen collection needle cannula can be passed into the specimen collection tube; a rubber-like elastic needle cannula penetrating portion provided to fill up the through-hole in the grip section and having the capability to be pierced by a needle cannula and reseal a hole if left after the needle cannula is retracted; and a rubber-like elastic fitting portion extending downward from a peripheral edge portion of the rubber-like elastic needle cannula penetrating portion and configured to follow an inner surface profile at the open end of the specimen collection tube so that it can contact fit therein in an airtight fashion. In particular, the needle cannula penetrating portion has a protuberance on its bottom surface.

For closure structures for a vacuum specimen collection container according to the first and second inventions of the present application, the through-hole is configured to increase its diameter toward an upward direction from the needle cannula penetrating portion.

In accordance with another particular aspect of the present invention, a wall thickness T1 (mm) and an oxygen permeability coefficient P1 ($ml/cm^2 \cdot mm^{-1} \cdot sec \cdot cmHg$) at 25° C. of the partition portion in the grip section, a wall thickness T2 (mm) in a needle penetrating direction and an oxygen permeability coefficient P2 ($ml/cm^2 \cdot mm^{-1} \cdot sec \cdot cmHg$) at 25° C. of the needle cannula penetrating portion, a minimum cross-sectional area Sd ($cm^2$) of the through-hole in the grip section and an open area So ($cm^2$) at the open end of the specimen collection tube are selected to satisfy the following relationship (1):

$$\frac{(So - Sd) \times P1}{T1} + \frac{Sd \times P2}{T2} \leqq 10 \times 10^{-10} \quad (1)$$

Preferably, the grip section comprises a thermoplastic resin composition having an oxygen permeability coefficient at 25° C., P1, of not exceeding $30 \times 10^{-10}$ $ml/cm^2 \cdot mm^{-1} \cdot sec \cdot cmHg$, the needle cannula penetrating portion comprises a thermoplastic elastomer composition having an oxygen permeability coefficient at 25° C., P2, of not exceeding $700 \times 10^{-10}$ $ml/cm^2 \cdot mm^{-1} \cdot sec \cdot cmHg$, and the fitting portion comprises a thermoplastic elastomer composition having an oxygen permeability coefficient at 25° C. of not exceeding $10{,}000 \times 10^{-10}$ $ml/cm^2 \cdot mm^{-1} \cdot sec \cdot cmHg$. Also, a ratio of a minimum cross-sectional area Sd of the through-hole in the grip section to an open area So at the open end of the specimen collection tube, Sd/So is adjusted not to exceed 0.7.

While not limiting the invention, the grip section is comprised principally of at lease one selected from the group consisting of polyester, polyamide, polyallylate, polyacetal and ethylene-vinyl alcohol copolymer, and the needle penetrating portion and the fitting portion are comprised of thermoplastic elastomer that can be chemically or thermally adhered to the grip section.

A vacuum specimen collection container according to the present invention includes a closure structure according to the present invention and a vacuum specimen collection tube.

In accordance with a particular aspect of the present invention, a vacuum specimen collection container includes a closure structure according to the second invention and a vacuum specimen collection tube having a rubber-like elastic, closure structure receiving portion at an inner face of its open end.

A vacuum specimen collection system according to the present invention includes a closure structure for a vacuum specimen collection container according to the present invention, a vacuum specimen collection tube, a tubular holder having an opening at its one end for receiving the vacuum specimen collection tube and a means at its another end for retaining a specimen collection needle cannula, and a vacuum specimen collection needle. Provided deep inside the holder on the needle cannula retaining side is an elastic member which has a recessed or raised portion engageable with the raised or recessed portion on the inner side of the tubular side wall in the grip section of the closure structure.

A holder according to the present invention is the holder for use in combination with a closure structure for a vacuum specimen collection container according to the present invention. The holder is characterized as being tubularly configured to have an opening at its one end for receiving a vacuum specimen collection tube and a means at its another end for retaining a specimen collection needle cannula and as being provided deep inside thereof on the needle cannula retaining side with an elastic member having a recessed or raised portion engageable with the raised or recessed portion on the inner side of the tubular side wall in the grip section of the closure structure.

In accordance with a further aspect of the present invention, a thermoplastic elastomer composition is provided which can be used to form a closure structure for a vacuum specimen collection container according to the present invention. This thermoplastic elastomer composition contains thermoplastic elastomer having rubber elastic domains produced via dynamic crosslinking under a catalyzing action of transition metal oxide, and a compound which can form a water-insoluble salt or chelate with the transition metal.

BEST MODES FOR CARRYING OUT THE INVENTION

The present invention will be now explained with reference to the following embodiments as applied to a vacuum blood collection container for collecting blood.

Figure 1:
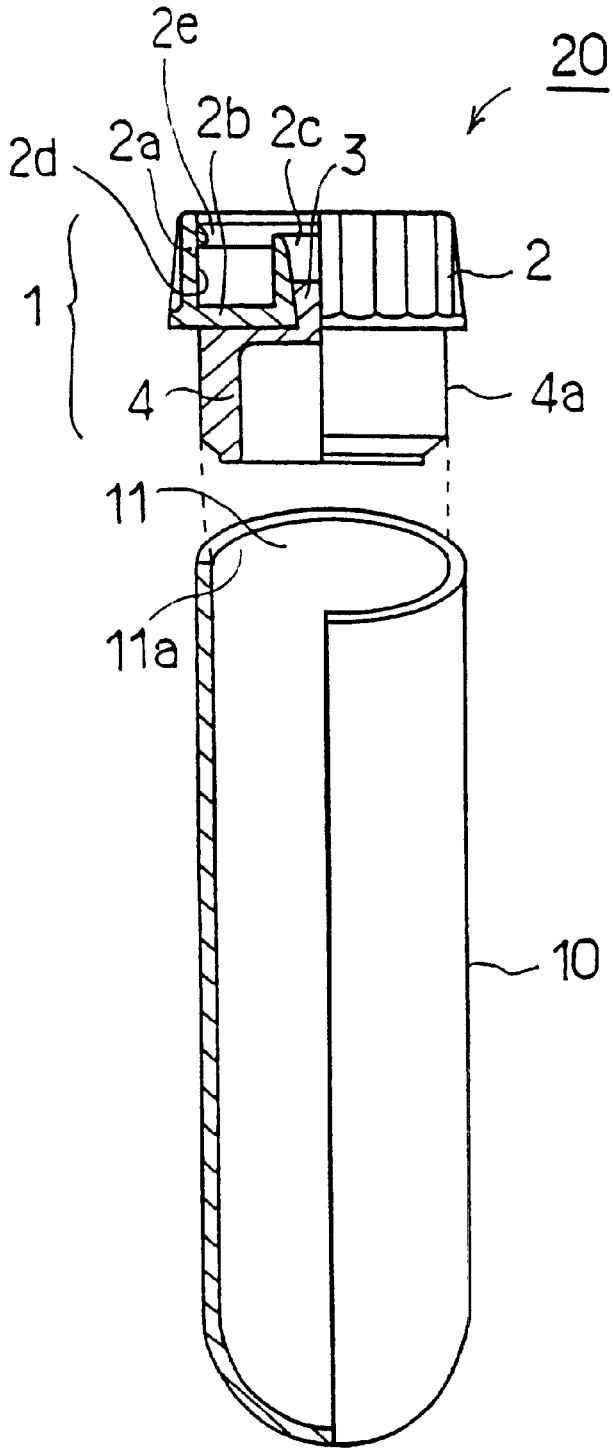
FIG. 1 is a partially cut-away sectional view showing a vacuum blood collection container embodiment in accordance with the present invention.

FIG. 1 is a partially cut-away sectional view of a vacuum blood collection container embodiment in accordance with the present invention. A vacuum blood collection container 20 includes a closure structure 1 and a blood collection tube 10. A grip section 2 defines an upper part of the closure structure 1 and is designed to be held by a finger tip when the closure structure is attached to or detached from the blood collection tube. The grip section 2 includes a hollow cylindrical side wall 2*a* and a partition portion 2*b* which extends inwardly from a bottom end of the side wall 2*a*. An inwardly-extending end of the partition portion 2*b* then projects upward to define a through-hole 2*c* inside thereof. This through-hole 2*c* provides a passage through which a blood collection needle cannula can be passed into the blood collection tube 10.

For the kickback preventive purpose, an annular rib 2*e* is provided on an inner surface 2*d* of the hollow cylindrical side wall 2*a* to extend circumferentially therealong adjacent its upper edge. The annular rib 2*e* is disposed such that a plane positioned parallel thereto extends in a direction perpendicular to an axial direction of the closure structure 1, i.e., to an axial direction of the vacuum blood collection tube 20.

The annular rib 2*e* is designed to engage a springy elastic member 64 which is disposed within an interior portion 63 of a holder 60 for vacuum blood collection devices, as will be later described with reference to FIG. 13, so as to locate on its vacuum blood collection needle holding side. The annular rib 2*e* resists a rebounding force produced when an elastic sheath 40 on a closure structure penetrating side of the below-described multiple blood collection needle 39 is compressed during blood collection, thereby serving to prevent the occurrence of a kickback phenomenon. When a sufficient pulling force is applied to the blood collection tube 10 on the holder 60 after the blood collection is completed, the annular rib 2*e* fails to resist the force to finally disengage from a recess 64*a*.

In this particular embodiment, the annular rib 2*e* is provided to accomplish the kickback protection. Instead, an annular groove may be provided for the same purpose. In such a case, an engaging part of the elastic member 64 within the interior 63 of the holder 60 is changed in shape to a rib. The groove, alternative to the annular rib 2*e* or rib 2*e*, may be provided to extend intermittently, but most preferably continuously around the inner surface 2*d* of the hollow cylindrical side wall 2*a*. That is, the kickback preventive rib or groove may be provided locally or in plurality.

A needle cannula penetrating portion 3 is provided to close the through-hole 2*c* in the grip section 2. This needle cannula penetrating portion 3 is made to exhibit rubber elasticity and configured to have a larger diameter toward its top end along an axial direction of the closure structure, i.e., constructed in a funnel-like configuration. As will be described later, the through-hole 2*c* preferably has a minimum cross-sectional area smaller than an open area of an open end 11 of the blood collection tube 10. Thus, the funnel-shaped inner wall around the through-hole 2*c* serves to precisely guide a vacuum blood collection needle or a sampling nozzle for specimen dispensing into the through-hole 2*c*.

In the particular embodiment shown in FIG. 1, the through-hole 2*c* is provided concentrically of the closure structure 1, i.e., at a location generally centrally of the grip section 2. However, the through-hole 2*c* may be shifted in location from a central axis of the closure structure 1. If necessary, the through-hole may be provided in plurality.

The closure structure 1 has a lower fitting portion 4 constructed in a generally hollow cylindrical configuration. The fitting portion 4 is made to exhibit rubber elasticity. Also, the fitting portion 4 is formed to extend downwardly from a peripheral region of a bottom surface of the needle cannula penetrating portion 3. The fitting portion 4 is a part which fits in the open end 11 of the blood collection tube 10 to contact with its inner surface 11*a*. That is, the fitting portion 4 is designed to fit in the open end 11 of blood collection tube 10 such that its peripheral surface 4*a* flexibly follows the surface profile of the inner surface 11*a* of the open end 11 of blood collection tube 10 to contact therewith. In the present embodiment, the fitting portion 4 is integrally formed with the needle cannula penetrating portion 3 from the same material.

In the present invention, the particular design parameters are preferably adjusted to satisfy the following relationship (1):

$$\frac{(So - Sd) \times P1}{T1} + \frac{Sd \times P2}{T2} \leqq 10 \times 10^{-10} \quad (1)$$

where T1 (mm) is a wall thickness of the partition portion 2*b* of the grip section 2, P1 ($ml/cm^2 \cdot mm^{-1} \cdot sec \cdot cmHg$) is an oxygen permeability coefficient of the partition portion at 25° C., T2 (mm) is a wall thickness of the needle cannula penetrating portion 3 in a needle penetrating direction, P2 ($ml/cm^2 \cdot mm^{-1} \cdot sec \cdot cmHg$) is an oxygen permeability coefficient of the needle cannula penetrating portion at 25° C., Sd ($cm^2$) is a minimum cross-sectional area of the through-hole 2*c* in the grip section 2, and So ($cm^2$) is an open area at the open end 11 of the blood collection tube 10.

The left side of the relationship (1) indicates gas barrier properties of the closure structure 1. If a value X given by the left side of the relationship (1) exceeds $10 \times 10^{-10}$, the capability of the closure structure to maintain the interior vacuum pressure of the blood collection tube 20 may deteriorate.

Examples of materials used to form the grip section 2 include thermoplastic resins, thermosetting resins, metals, ceramics and the like. The use of thermoplastic resins is preferred for its increased productivity and economical efficiency.

Examples of materials used to form the needle cannula penetrating portion 3 and the fitting portion 4 include thermoplastic elastomers and thermosetting elastomers. In view of productivity and economical efficiency, the use of thermoplastic elastomers is preferred.

More preferably, the closure structure in accordance with the present embodiment satisfies not only the above relationship (1) but also the following conditions:

① The grip section 2 is formed from a thermoplastic resin composition having an oxygen permeability coefficient at 25° C. of not exceeding $30 \times 10^{-10}$ $ml/cm^2 \cdot mm^{-1} \cdot sec \cdot cmHg$;

② The needle cannula penetrating portion 3 is formed from a thermoplastic elastomer composition having an oxygen permeability coefficient at 25° C. of not exceeding $700 \times 10^{-10}$ $ml/cm^2 \cdot mm^{-1} \cdot sec \cdot cmHg$;

③ The fitting portion 4 is formed from a thermoplastic elastomer composition having an oxygen permeability coefficient at 25° C. of not exceeding $10{,}000 \times 10^{-10}$ $ml/cm^2 \cdot mm^{-1} \cdot sec \cdot cmHg$; and ④ The ratio of a minimum cross-sectional area Sd of the through-hole 2*c* in the grip section 2 to an open area So at the open end 11 of blood collection tube 10, i.e., Sd/So does not exceed 0.7.

As described above, the grip section 2 is preferably formed from a thermoplastic resin composition having an oxygen permeability coefficient at 25° C. of not exceeding $30 \times 10^{-10}$ $ml/cm^2 \cdot mm^{-1} \cdot sec \cdot cmHg$. Examples of substances which can be used as a principal constituent of the thermoplastic resin composition include polyester, polyacrylonitrile, polyamide, polyallylate, polyacetal, polyacrylate, polycarbonate, polyvinyl chloride, polyvinylidene chloride, acrylonitrile/styrene copolymer, ethylene/vinyl alcohol copolymer, polystyrene, polypropylene, high-density polyethylene, low-density polyethylene and the like. These substances may be used alone or in any combination thereof. In the case where two or more of those thermoplastic resins are used in combination, they may be either multilayered or mixed together.

More preferably, the grip section 2 has an oxygen permeability coefficient at 25° C. of not exceeding $15 \times 10^{-10}$ $ml/cm^2 \cdot mm^{-1} \cdot sec \cdot cmHg$. Examples of thermoplastic resins which can impart such an oxygen permeability coefficient to the grip section include polyester, polyacrylonitrile, polyamide, polyallylate, polyacetal, ethylene/vinyl alcohol copolymer, polyvinyl chloride, polyvinylidene chloride, polyacrylate, acrylonitrile/styrene copolymer, high-density polyethylene, polycarbonate and the like. These may be used alone or in any combination thereof.

Still more preferably, the grip section 2 has an oxygen permeability coefficient at 25° C. of not exceeding $5 \times 10^{-10}$ $ml/cm^2 \cdot mm^{-1} \cdot sec \cdot cmHg$. Examples of thermoplastic resins which can impart such an oxygen permeability coefficient to the grip section include polyester, polyacrylonitrile, polyamide, polyallylate, polyacetal, ethylene/vinyl alcohol copolymer, polyvinyl chloride, polyvinylidene chloride, polyacrylate, acrylonitrile/styrene copolymer, high-density polyethylene and the like. These may be used alone or in any combination thereof.

If the oxygen permeability coefficient at 25° C. of the grip section 2 is excessively high, it may become necessary to increase a wall thickness of the partition portion 2*b* in the grip section 2 and/or a wall thickness of the needle cannula penetrating portion 3. Alternatively, substances used to form the needle cannula penetrating portion 3 and/or fitting portion 4 may be limited to those having lower oxygen permeability coefficients. These possibly result in the increased resistance to needle cannula penetration and the reduced productivity and economical efficiency.

As stated above, the needle cannula penetrating portion 3 is preferably formed from a thermoplastic elastomer composition having an oxygen permeability coefficient at 25° C. of not exceeding $700\times10^{-10}$ ml/cm$^2$·mm$^{-1}$·sec·cmHg. Examples of substances which can be used as a principal constituent of the thermoplastic elastomer composition to impart such an oxygen permeability coefficient thereto include diblock copolymer and triblock copolymer of styrene-, urethane-, amido-, ester-, vinyl chloride- or olefin-based elastomer; and ethylene/vinyl acetate copolymer. These substances may be used alone or in any combination thereof. A variety of additives may further be added to the thermoplastic elastomer composition. In the case where two or more of those thermoplastic elastomers are used in combination, they may be combined in any fashion, e.g., either multilayered or mixed together.

In the case where the olefin-based elastomer is used in combination with the other substance-based elastomers, an additional thermoplastic elastomer may further be used, examples of which include styrene/hydrogenated butadiene block copolymer, styrene/hydrogenated isoprene block copolymer, styrene/isobutylene block copolymer, styrene/ethylene propylene block copolymer and the like.

Where the styrene/hydrogenated butadiene thermoplastic elastomer is used, the butadiene block preferably contains 1, 2-coupling constituents. Where the styrene/hydrogenated isoprene thermoplastic elastomer is used, the isoprene block preferably contains 3, 4-coupling constituents. The use of the above-described thermoplastic elastomers increases the compatibility of the olefin-based elastomer with other substance-based elastomers.

More preferably, the needle cannula penetrating portion 3 has an oxygen permeability coefficient at 25° C. of not exceeding $200\times10^{-10}$ ml/cm$^2$·mm$^{-1}$·sec·cmHg. Examples of substances which can be used as a principal constituent of the thermoplastic elastomer composition to impart such an oxygen permeability coefficient thereto include styrene-based elastomers containing isobutylene blocks, olefin-based elastomers having crosslinked isobutylene domains, urethane-, amido- and ester-based elastomers. These elastomers may be used alone or in any combination thereof.

The crosslinked isobutylene domains having rubber elasticity may be obtained by crosslinking the isobutylene-isoprene copolymer according to a so-called dynamic crosslinking technique. In such a case, transition metal oxides, such as zinc oxide, are frequently used to catalyze the crosslinking reaction. In order to prevent metal ions from eluting from these metal oxide catalysts, it is desirable to use, in combination therewith, compounds that can react with the metal ions to form insoluble salts or insoluble chelates.

If the oxygen permeability coefficient at 25° C. of the needle cannula penetrating portion 3 is excessively high, it may become necessary to increase a wall thickness of the partition portion 2*b* in the grip section 2 and/or a wall thickness of the needle cannula penetrating portion 3. Alternatively, substances used to form the grip section 2 may be limited to those having lower oxygen permeability coefficients. These possibly result in the increased resistance to needle cannula penetration and the reduced productivity and economical efficiency.

The above-described thermoplastic elastomers for use in the formation of needle cannula penetrating portion 3 can also be used to form the fitting portion 4. Those comprised primarily of silicone elastomer can also be used. Such elastomers can be used alone or in any combination thereof.

The capability of the needle cannula penetrating portion 3 to provide an airtight seal relies largely upon the magnitude of the oxygen permeability coefficient of the particular rubber elastic material used. In contrast, the ability of the fitting portion 4 to achieve an airtight engagement relies largely upon the flexibility of its peripheral surface 4*a* to follow the surface profile of the inner surface 11*a* at the open end 11 of blood collection tube 10. Accordingly, the oxygen permeability coefficient of the rubber elastic material used to form the vicinity of the peripheral surface 4*a* may be made larger than that of the needle cannula penetrating portion 3.

It is desired that the fitting portion 4 has an oxygen permeability coefficient at 25° C. of not exceeding $10{,}000\times10^{-10}$ ml/cm$^2$·mm$^{-1}$·sec·cmHg. If the oxygen permeability coefficient exceeds the above-specified range, it may become necessary to increase a wall thickness of the partition portion 2*b* in the grip section 2 and/or a wall thickness of the needle cannula penetrating portion 3. Alternatively, resins used to form the grip section 2 may be limited to those having lower oxygen permeability coefficients. These possibly result in the increased resistance to needle cannula penetration and the reduced productivity and economical efficiency.

The needle cannula penetrating portion 3 and fitting portion 4 are preferably formed from a thermoplastic elastomer composition having an oxygen permeability coefficient at 25° C. of not exceeding $700\times10^{-10}$ ml/cm$^2$·mm$^{-1}$·sec·cmHg, more preferably from a thermoplastic elastomer composition having an oxygen permeability coefficient at 25° C. of not exceeding $200\times10^{-10}$ ml/cm$^2$·mm$^{-1}$·sec·cmHg. Still more preferably, the cannula penetrating portion 3 and fitting portion 4 are integrally formed from the same thermoplastic elastomer composition. This results in the increased productivity.

Also, the outer surface 4*a* of the fitting portion 4 that is brought into a slidable contact with the inner surface 11*a* at the open end 11 of blood collection tube 10 preferably has a JIS hardness A or an ASTM Shore hardness A of not exceeding 80, more preferably of not exceeding 60. The excessively high JIS hardness A or ASTM Shore hardness A may lead not only to the increased resistance to needle cannula penetration and fitting into the blood collection tube but also to the looser contact of the fitting portion with the inner surface 11*a* of the blood collection tube 10, possibly resulting in the reduced working and airtight properties.

Preferably, lubricants, e.g., oils, waxes, aliphatic acids, surfactants, plasticizers and lubricating inorganic fine powders, may be coated onto the outer periphery 4*a* of the fitting portion 4 by conventionally known techniques such as spraying, dipping and tumbling to facilitate its attachment to or detachment from the open end 11 of the blood collection tube 10. Alternatively, they may be added to the elastomer composition prior to its fabrication into the fitting portion 4.

The ratio, Sd/So, of a minimum cross-sectional area Sd of the through-hole 2*c* in the grip section 2 to an open area So at the open end 11 of the blood collection tube 10 is preferably designed not to exceed 0.7. If Sd/So exceeds 0.7, it may become necessary to increase a wall thickness of the needle cannula penetrating portion 3 and/or a wall thickness of the partition portion 2*b* in the grip section 2. Alternatively, the materials usable to form the closure structure may be limited to those having lower oxygen permeability coefficients. These possibly result in the increased resistance to needle cannula penetration and the reduced productivity and economical efficiency.

More preferably, Sd/So is designed not to exceed 0.5. This allows the reduced wall thickness of the needle cannula penetrating portion 3 or the partition portion 2*b* in the grip section 2, resulting in the reduced resistance to needle cannula penetration and the increased productivity and economical efficiency. Still more preferably, Sd/So is designed not to exceed 0.3. This not only provides the above benefits but also allows the use of closure structure forming materials having relatively large oxygen permeability coefficients, resulting in the further increased economical efficiency.

The grip section 2 is preferably formed from a thermoplastic resin composition comprised principally of at least one non-olefin thermoplastic resin selected from polyester, polyamide, polyallylate, polyacetal and ethylene/vinyl alcohol copolymer. The needle cannula penetrating portion 3 and fitting portion 4 are preferably formed from a thermoplastic elastomer composition comprised principally of thermoplastic elastomer having the property to be chemically or thermally adhered to the grip section 2. Examples of such principal thermoplastic elastomers include styrene-based elastomers containing isobutylene blocks, olefin-based elastomers having crosslinked isobutylene domains, urethane-, amido- and ester-based elastomers. These elastomers can be used alone or in any combination thereof.

The use of the aforementioned non-olefin thermoplastic resin composition and thermoplastic elastomer composition as forming materials is effective in suppressing the production of toxic gases when they are burned up.

Preferably, the loading of nonflammable fillers in these compositions may be controlled not to exceed 10 wt. %. This results in the reduction in amount of ashes left after the compositions have been burned.

The ability of the needle cannula penetrating portion 3 and fitting portion 4 to be chemically or thermally adhered to the grip section 2 leads to regulating a flow of external atmosphere through between faces of these members, thereby effectively maintaining an interior vacuum pressure of a blood collection container.

The closure structure 1 can be manufactured by a variety of conventionally-known fabrication techniques, such as injection molding, vacuum forming and extrusion. For example, the grip portion 2 is preformed by an injection molding technique and then an insert molding technique is utilized to integrate it with the needle cannula penetrating portion 3 and fitting portion 4. They may be simultaneously formed by a multi-member injection molding technique (multiple injection molding technique). Alternatively, they may be formed separately and then assembled. It is then desired that the separately-formed members are assembled in an airtight manner such that the interior vacuum pressure of the blood collection container can be maintained. To this end, such separate members may be brought into close engagement with each other. More preferably, they may be adhesively joined as by a hotmelt or cure-reactive adhesive, or thermally jointed by a supersonic or high-frequency technique.

Where the constituent members of the closure structure 1 are formed from dissimilar materials, an adhesion promoter or a compatibilizer may preferably be coated or layered on each member to increase their chemical or thermal adhesion. Such additives may alternatively be incorporated in the materials prior to formation into those members.

When desired to facilitate distinguishing the type of a reagent contained in the blood collection tube 10, the grip section 2 and other constituent members of closure structure 1 may be made discernable by coloring with pigments or dyes, applying prints, or fitting a separately-formed colored member thereto.

The material type of the blood collection tube 10 is not particularly specified, and may be soft glass, hard glass, borosilicate glass or the like. Also useful are rigid thermoplastic resins including polyethylene terephthalate, polybutylene terephthalate, polyethylene naphthalate, polyacrylonitrile, polyamide, polyallylate, polyacrylate, polyvinyl chloride, polyvinylidene chloride, polypropylene, acrylonitrile/styrene copolymer, ethylene/vinyl alcohol copolymer and the like. Particularly suitable is a thermoplastic resin composition containing at least one of the above-listed thermoplastic resins such that it has an oxygen permeability coefficient at 25° C. of not exceeding $30\times10^{-10}$ $ml/cm^2\cdot mm^{-1}\cdot sec\cdot cmHg$. The above-listed thermoplastic resins may be used alone or in combination. In the latter case, two or more of those thermoplastic resins can be used in a layered or kneaded form.

Also, the blood collection tube 10 can be manufactured by a variety of conventionally known techniques, such as injection molding and blow molding. For example, a suitable composition may be extruded into a pipe form and cut to a desired length. The closure of one end of the pipe, as by attaching a separate member or fitting the closure structure 1 thereto, then results in the formation of a closed-bottom container.

The blood collection tube 10 may or may not contain conventionally known reagents and auxiliaries. Examples of reagents include blood coagulation promoter, anticoagulants, glycolysis inhibitors, protease inhibitors, deproteinizing agents, culture media, pH control agents and the like. Examples of auxiliaries include those which serve to help the specimen pretreatment to proceed smoothly, such as serum-separating media, blood component anti-adhesion agents and the like.

Figure 2:
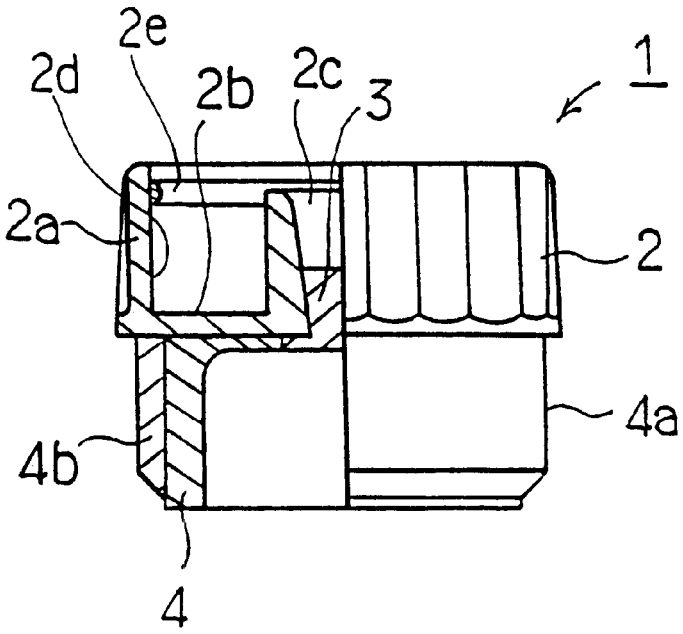
FIG. 2 is a partially cut-away sectional view showing another closure structure embodiment for a vacuum blood collection container in accordance with the present invention.

FIG. 2 is a partially cut-away sectional view, showing a closure structure for blood collection container in accordance with another embodiment of the present invention. In the closure structure shown in FIG. 2, a surface layer portion 4*b*, which defines at least a part of the peripheral surface 4*a* of the fitting portion 4 that comes into close contact with the inner surface of the open end of blood collection tube, is constructed from rubber-like material different in type from the needle cannula penetrating portion. As stated earlier, the ability of the needle cannula penetrating portion 3 to provide an airtight closure relies largely upon the magnitude of the oxygen permeability coefficient of the particular rubber elastic material used. In contrast, the ability of the fitting portion 4 to achieve an airtight engagement relies largely upon the flexibility of its peripheral surface 4*a* to follow the surface profile of the inner surface 11*a* at the open end 11 of blood collection tube 10. Accordingly, the oxygen permeability coefficient of the rubber elastic material used to form the vicinity of the peripheral surface 4*a* may be made larger than that of the needle cannula penetrating portion 3.

Figure 3:
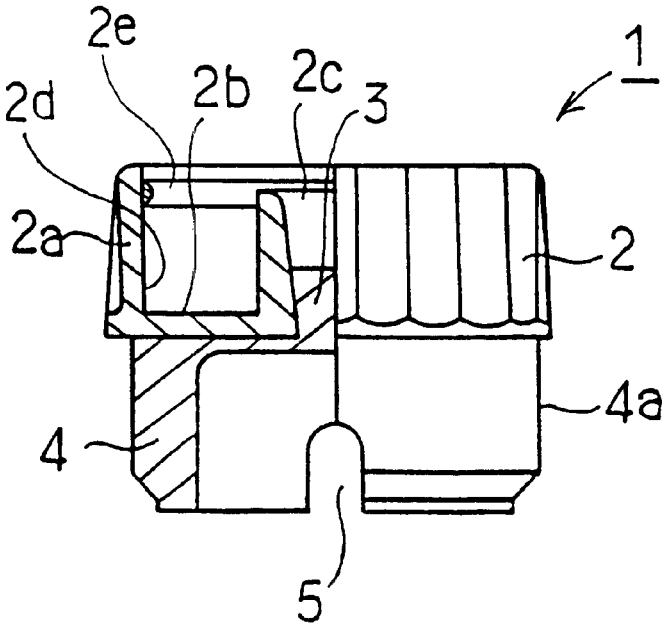
FIG. 3 is a partially cut-away sectional view showing a further closure structure embodiment for a vacuum blood collection container in accordance with the present invention.

FIG. 3 is a partially cut-away sectional view, showing a closure structure for blood collection container in accordance with another preferred embodiment of the present invention. In the embodiment shown in FIG. 3, a lower portion of the generally hollow cylindrical fitting portion 4 is partially cut out to provide a channel 5 which extends upward from a bottom end of the fitting portion 4. Otherwise, the closure structure is similar in construction to the embodiment shown in FIG. 1. Accordingly, the description of other components is omitted here. When the closure structure 1 is attached to or detached from the open end of blood collection tube, the channel 5 allows a gas flow into or from the interior of the blood collection tube. Usually, the closure structure is detached from the blood collection tube for dispensing a part of specimen therefrom. When it is reattached, an excess open air is entrained and compressed in the interior of the blood collection tube and the compressed air produces a counterforce which acts to push up the closure structure. However, the presence of the channel 5 suppresses the action of such a counterforce to thereby prevent the closure structure from being pushed off by the compressed air.

The shape of the cutout channel 5 is not particularly specified. Preferably, the channel 5 is shaped smoothly so as not to leave sharp edges and capillaries where blood clots could be held to reside.

Figure 4:
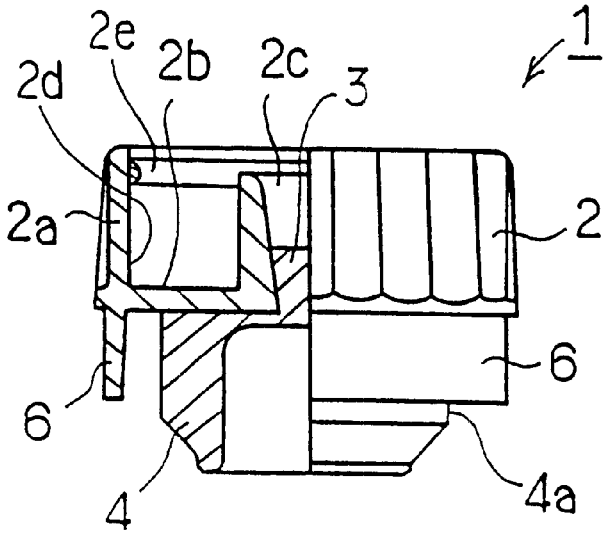
FIG. 4 is a partially cut-away sectional view showing a further closure structure embodiment for a vacuum blood collection container in accordance with the present invention.

FIG. 4 is a partially cutaway sectional view, showing a closure structure for use in the vacuum blood collection container in accordance with still another embodiment of the present invention. In the embodiment shown in FIG. 4, a generally tubular cover 6 is provided to depend from a peripheral bottom edge of the grip section 2 and extend around the generally hollow cylindrical fitting portion 4. The fitting portion 4 is thus located inside the cover 6. The proportion in diameter of the grip section 2 to the fitting portion 4 in this embodiment is made relatively larger compared to those in the embodiments shown in FIGS. 1–3.

The provision of the cover 6, as in the embodiment shown in FIG. 4, serves to provide a wider finger grip region on the closure structure 2, resulting in the improved attaching and detaching operations. The cover 6 length may be dimensioned so that its distal end extends further downward to fully cover the fitting portion 4. Such design shuts off the blood, if caused to splash when the closure structure 1 is detached from the blood collection tube.

Such a cover 6 can be integrally formed with the grip section 2.

Figure 5:
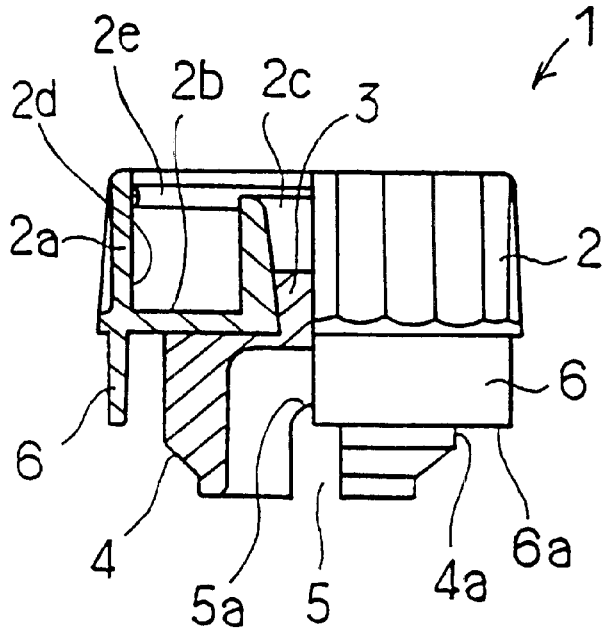
FIG. 5 is a partially cut-away sectional view showing a further closure structure embodiment for a vacuum blood collection container in accordance with the present invention.

FIG. 5 is a partially cutaway sectional view, showing a closure structure for use in the vacuum blood collection container in accordance with still another embodiment of the present invention. In this embodiment, the fitting portion 4 is partially cut out to provide the channel 5, as similar to the embodiment shown in FIG. 3. The grip section 2 is made relatively larger in diameter and has a peripheral bottom edge from which the cover 6 depends so as to surround the fitting portion 5, as similar to the embodiment shown in FIG. 4. This construction not only prevents the closure structure from being caused to move upward when it is detached and then reattached, resulting in the improved attaching and detaching operations, but also shuts off the blood if caused to splash when the closure structure is detached from the blood collection tube.

In the case where both the cutout channel 5 and the cover 6 are provided as illustrated in this embodiment, the cover 6 is preferably dimensioned so as for its lower end to extend below a deep end 5*a* of the cutout channel 5. The cover 6 having such a sufficient length can shield the vicinity of the deep end 5*a* of the cutout channel 5. Accordingly, when the closure structure 1 is detached from the blood collection tube, the cover 6 blocks the blood even if caused to splash through the deep end region of the cutout channel 5 which has just exited from the open end of blood collection tube. This eliminates the possibility for a tester to catch the blood splash.

Where the cutout channel 5 is provided, the blood splashing tends to occur at the deep end region of the cutout channel 5. The cover 6 can thus be made shorter than shown in the embodiment of FIG. 4. The relative reduction in length of the cover 6 leads to the reduced area of the cover 6 that shall cover the open end of blood collection tube when the closure structure 1 is attached thereto. This results in the reduced occurrence of the cover 6 to hide a specimen identifying label or a bar code that may be affixed or printed on an outer wall surface of the blood collection tube.

Figure 6:
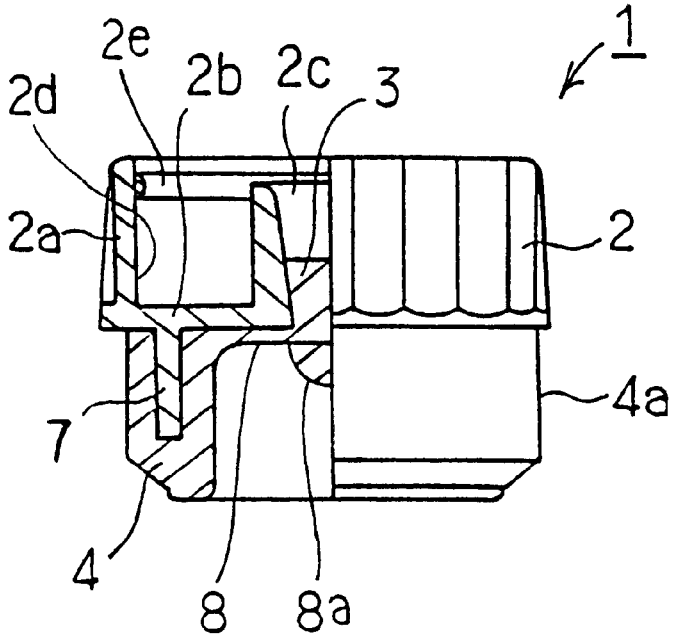
FIG. 6 is a partially cut-away sectional view showing a further closure structure embodiment for a vacuum blood collection container in accordance with the present invention.

FIG. 6 is a partially cutaway sectional view, showing a closure structure for use in the vacuum blood collection container in accordance with still another embodiment of the present invention. In this embodiment, a member 7 is provided to support the fitting portion. This supporting member 7 extends downward from the partition portion 2*b* in the grip section 2 into a body of the fitting portion 4. The supporting member 7 has a generally tubular configuration and is embedded into the generally tubular fitting portion 4.

The needle cannula penetrating portion 3 has an inner surface 8 which faces toward the blood collection tube and is positioned to locate above a lower end of the supporting member 7. A generally semi-spherical protuberance 8*a* is formed on the inner surface 8.

The supporting member 7 is provided to increase the structural integrity of the grip section 2 with the fitting portion 4. Besides, it serves to suppress the excessive deformation of the rubber-like elastic fitting portion 4 when the closure structure 1 is detached or attached.

However, the provision of the supporting member 7 may influence in such a manner as to reduce the stress produced between the fitting portion 4, which acts to reseal a needle hole if pierced in the needle cannula penetrating portion 3, and the open end 11 of blood collection tube 10, possibly resulting in the reduced needle hole resealability.

When the internal pressure of a specimen contained in the blood collection tube 10 is caused to build up for some reason, a hydrostatic pressure applies in a direction normal to the inner surface 8 of the needle cannula penetrating portion 3. Because the penetrating direction of the needle is generally perpendicular to the inner surface 8, the hydrostatic pressure applies in the penetrating direction of the needle. This may cause a backflow of the specimen to occur while readily push widening the needle hole, possibly resulting in the leakage toward an outer surface of the needle cannula penetrating portion 3.

However, since the needle cannula penetrating portion 3 in the present embodiment has the protuberance 8*a* on its inner surface 8, the hydrostatic pressure applies not in the penetrating direction of needle but in a direction normal to a surface of the protuberance 8*a,* i.e., in a direction to close the needle hole. This results in the increased needle hole sealability.

The configuration of the protuberance 8*a* is not limited to the general semi-sphere, and may be generally cylindrical or generally truncated conical. The protuberance 8*a* is preferably integrally formed with the needle cannula penetrating portion 3.

While shown in the embedded form, the supporting member 7 may be arranged to extend along the inner wall surface of the fitting portion 4. Also, while shown to be generally tubular, the supporting member 7 may consist of pillars circumferentially arranged in a row.

Figure 7:
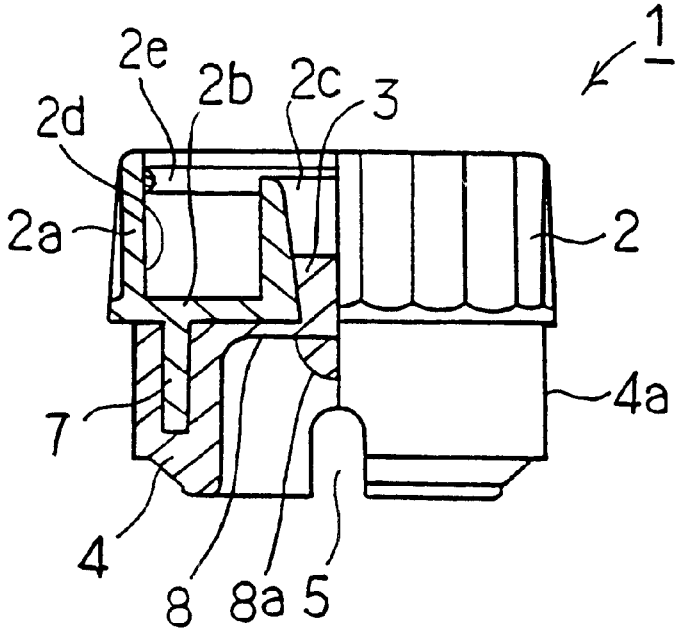
FIG. 7 is a partially cut-away sectional view showing a further closure structure embodiment for a vacuum blood collection container in accordance with the present invention.

FIG. 7 is a partially cutaway sectional view, showing a closure structure for use in the vacuum blood collection container in accordance with still another embodiment of the present invention. In this embodiment, the supporting member 7 for reinforcing the fitting portion 4 is provided in the grip section 2, and the cutout channel 5 in the fitting portion 4, as similar to the embodiment shown in FIG. 6. The closure structure 1 can thus be prevented from being pushed off by compressed air when the closure structure 1 once detached from the blood collection tube is reattached thereto.

Figure 8:
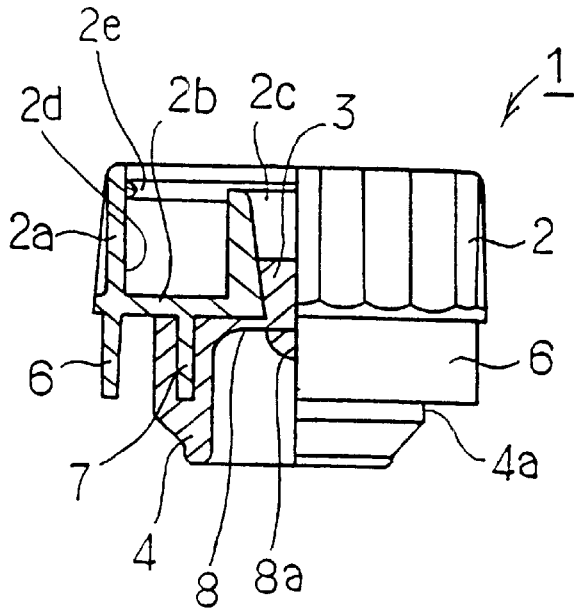
FIG. 8 is a partially cut-away sectional view showing a further closure structure embodiment for a vacuum blood collection container in accordance with the present invention.

FIG. 8 is a partially cutaway sectional view, showing a closure structure for use in the vacuum blood collection container in accordance with still another embodiment of the present invention. In this embodiment, the supporting member 7 is provided to reinforce the fitting portion 4 which is circumferentially surrounded by the cover 6. The provision of the cover 6 results in obtaining the same action and effect as in the embodiment shown in FIG. 4. In the fabrication of the grip section 2, the supporting member 7 and cover 6 can be integrally formed.

Figure 9:
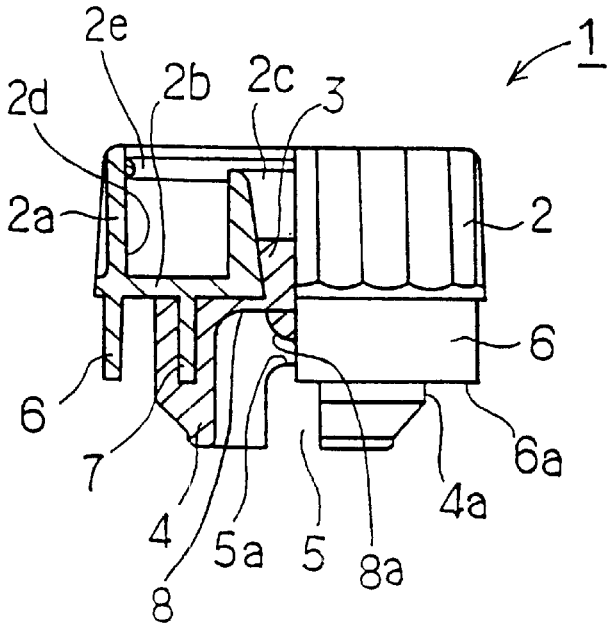
FIG. 9 is a partially cut-away sectional view showing a further closure structure embodiment for a vacuum blood collection container in accordance with the present invention.

FIG. 9 is a partially cutaway sectional view, showing a closure structure for use in the vacuum blood collection container in accordance with still another embodiment of the present invention. In this embodiment, the supporting member 7 is provided to reinforce the fitting portion 4 which has the cutout channel 5 and is circumferentially surrounded by the cover 6. The provision of the cutout channel 5 and cover 6 results in obtaining the same action and effect as in the embodiment shown in FIG. 5.

Figure 10:
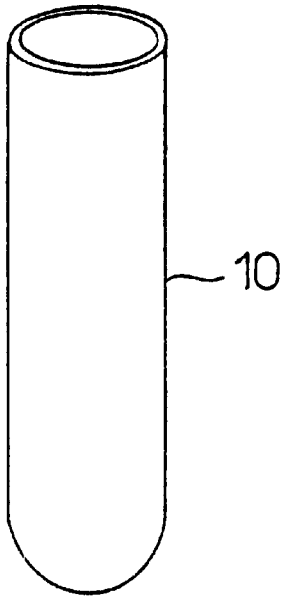
FIG. 10 is a perspective view showing a blood collection tube embodiment for a vacuum blood collection container in accordance with the present invention.
Figure 11:
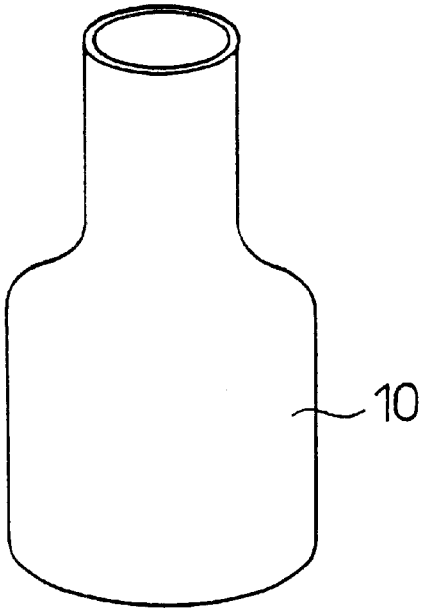
FIG. 11 is a perspective view showing another blood collection tube embodiment for a vacuum blood collection container in accordance with the present invention.

FIG. 10 is a perspective view of a blood collection tube for use in vacuum blood collection containers in accordance with the above-described embodiments. The shown blood collection tube is identical to that shown in FIG. 1. The configuration of the blood collection tube for use in the present invention is not limited to that shown in FIG. 10. Various configurations of blood collection tubes, including conventionally known tubes, can be employed which include, for example, the bottle-like blood collection tube having a diameter reduced toward a top opening end and increased toward a bottom end as shown in FIG. 11.

Figure 13A:
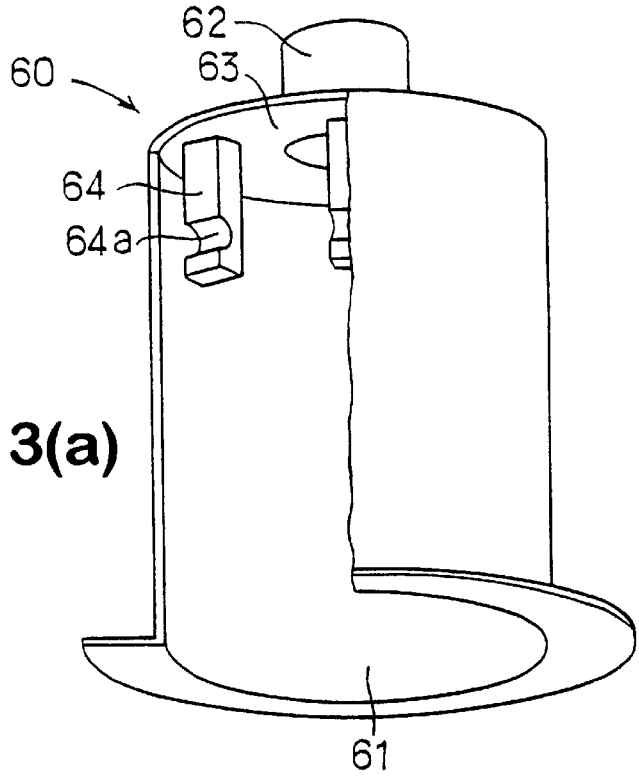
FIGS. 13(*a*) and 13(*b*) are partially cut-away perspective views respectively showing a vacuum blood collection device holder embodiment and another vacuum blood collection device holder in accordance with the present invention.
Figure 13B:
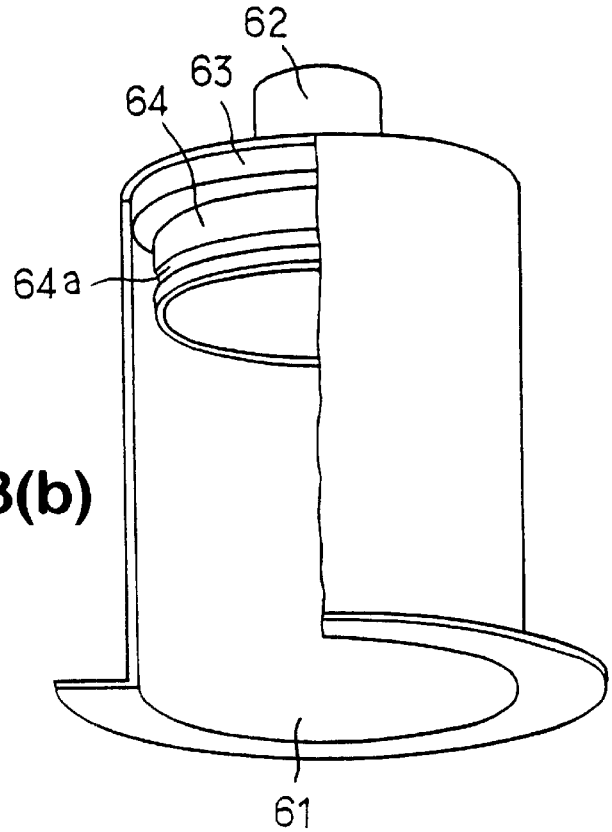

FIG. 13(*a*) is a partially cutaway sectional view, showing a holder for vacuum blood collection devices in accordance with still another embodiment of the present invention.

The vacuum blood collection device holder 60 has at its one end an opening 61 which allows insertion of a vacuum blood collection tube 20 thereinto and at its other end a needle holding portion 62 for retaining a vacuum blood collection needle 39. A spring-like elastic member 64 is disposed at an innermost portion 63 of the holder 60 adjacent the holding portion 62. The spring-like elastic member 64 has a groove 64*a* which is configured to be freely engageable with the aforementioned kickback-preventive rib 2*e* of the closure structure 1. The groove 64*a* of spring-like elastic member 64 is spaced from an inner surface of the innermost portion 63 to extend parallel thereto.

The elastic member 64 may be disposed at one or more locations and preferably at plural locations along a general circle. In the case where the kickback preventive element in the closure structure 1 is changed in configuration from a rib to a groove, the groove 64*a* in the holder 60 will be accordingly changed to a rib.

Various types of thermoplastic resins, thermosetting resins and metals can be used to form the spring-like elastic member 64. The use of thermoplastic resins is preferred for the increased productivity, although it is not limiting. That is, the use of tough and rigid thermoplastic resins is preferred, examples of which include polyester, polyamide, polyallylate, polyoxymethylene (polyacetal), polycarbonate, polypropylene, acrylonitrile/butadiene/styrene copolymer (acrylonitrile/styrene copolymer) and the like.

The spring-like elastic member 64 may be integrally formed with the holder 60. Alternatively, the separately formed spring-like elastic member may be joined to the holder 60. The technique to join them is not particularly specified. They may be joined adhesively, thermally or by a mating structure provided between them.

The elastic member 64 may be constructed in a generally tubular form such that the groove 64*a* extends continuously around a peripheral surface of the elastic member, as shown in FIG. 13(*b*). Such a construction increases the rigidity of the elastic member and accordingly allows the formation of elastic member 64, as a separate member, from rubber elastic materials such as thermoplastic elastomers and thermosetting elastomers. The separately formed elastic member 64 will be secured to the innermost portion 63 of the holder 64.

When in use, the holder 60 retains a vacuum blood collection needle 39. A needle cannula 38 is then inserted into a blood vessel. Subsequently, the vacuum blood collection tube 20 carrying the closure structure 1 attached thereto is inserted in the holder 60. As the needle cannula 37 advances deeper in the needle cannula penetrating portion 3 of the closure structure 1, an elastic sheath 40 is more compressed and a counterforce accompanying the compression starts to be applied to the vacuum blood collection tube 20. However, when an upper end of the tubular side wall 2*a* in the grip section 2 of the closure structure 1 advances between the elastic member 64 and the inner surface of the holder and reaches a position where the rib 2*e* on the closure structure 1 engages with the groove 64*a* on the holder 64, the engagement withstands the counterforce accompanying compression of the elastic sheath 40 so that the vacuum blood collection tube 20 can be kept retained within the holder 60. This allows the blood collection to proceed smoothly.

When the blood collection is completed, a force may be applied in a pulling direction so that the rib 2*e* is caused to disengage from the groove 64*a,* whereby the vacuum blood collection tube 20 can be removed from the holder 60.

As described above, the kickback prevention is achieved by utilizing the inner surface of side wall 2*a* in the grip section 2 of closure structure 1. This eliminates the need to enlarge an outer diameter of the grip section 2 to such an extent that an outer surface of the grip section 2 can be brought into slidable contact with an inner surface of the holder. Accordingly, even in the case where a small-size vacuum blood collection tube having a volume of 4–7 ml is employed, it can be inserted smoothly in a conventional test tube rack and retained in an upright position.

Figure 14:
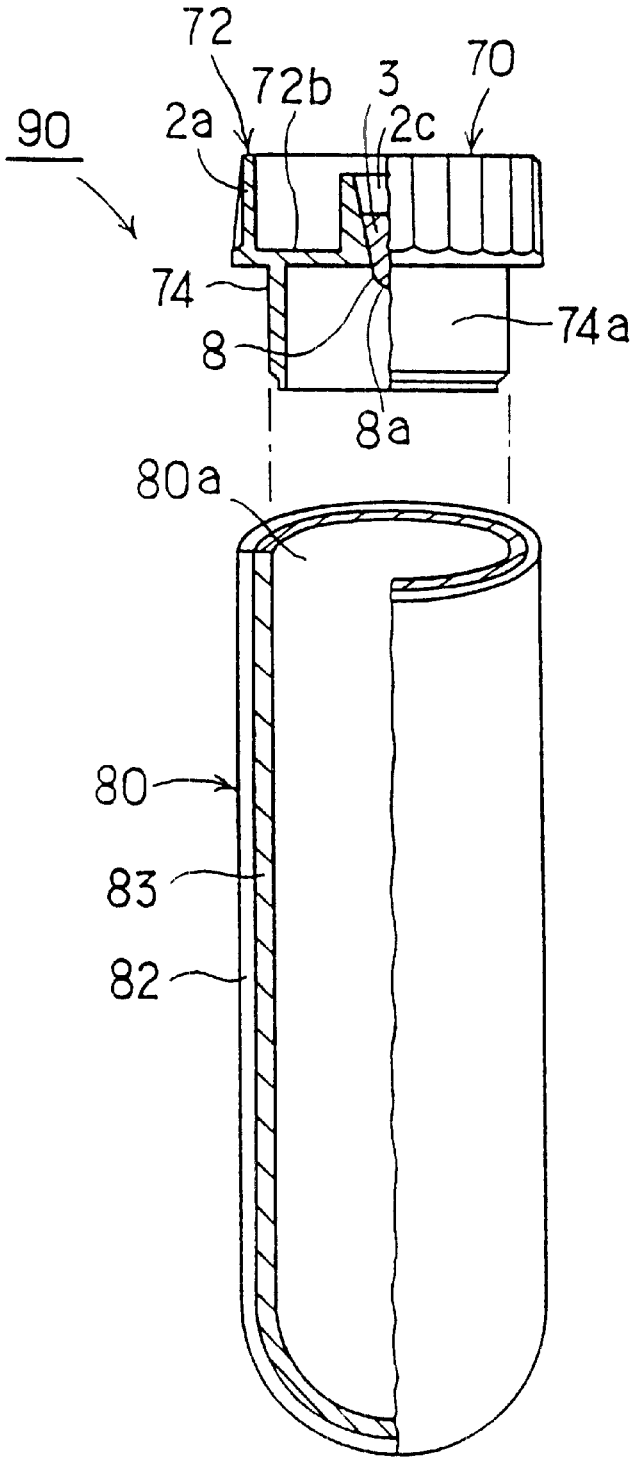
FIG. 14 is a partially-sectioned perspective view showing another vacuum blood collection container embodiment in accordance with the present invention.

FIG. 14 is a partially cut-away fragmentary sectional view, showing a vacuum blood collection tube in accordance with still another embodiment of the present invention. The vacuum blood collection tube 90 has a closure structure 70 and a blood collection tube 80.

In the closure structure 70, the kickback preventive rib 2*e* is not formed. The protuberance 8*a* is provided on a bottom surface 8 of the needle cannula penetrating portion 3. A fitting portion 74 is disposed to extend downward from a bottom surface of a partition portion 72*b*. Otherwise, the closure structure 70 is similar in construction to the closure structure 1 shown in FIG. 1.

Accordingly, the descriptions of like parts are omitted here by denoting them like reference numerals.

In the closure structure 70, the needle cannula penetrating portion 3 is disposed to close the through-hole 2*c* and is provided at its bottom face 8 with the generally semi-spherical protuberance 8*a*. The provision of the protuberance 8*a* increases the needle hole sealability.

In the blood collection tube 80, a bottom-closed tubular container 82 having rubber elasticity fits inside a bottom-closed rigid tubular container 83, like a telescopic structure, whereby the inner face at the opening end of the blood collection tube 80 provides a rubber elastic surface which receives the closure structure. Since the inner surface 80*a* of the blood collection tube 80 is flexible enough to follow a profile of an outer surface 74*a* of fitting portion 74, the closure structure 70 can be attached to the blood collection tube in an airtight fashion and accordingly the interior vacuum pressure of the blood collection tube 80 can be maintained.

Instead of using the rubber elastic tubular container 83, a rubber-like elastic material may be provided only on an inner surface region of the tubular container 82 that receives the outer surface 74*a* of the fitting portion 74.

Also in the vacuum blood collection container according to this embodiment, a kickback preventive rib or groove may be formed in the closure structure 70.

The general and preferred materials listed in the preceding description of the vacuum blood collection container 20 shown in FIG. 1 can also be used to form a grip section 72 and the needle cannula penetrating portion 3 in this embodiment.

The rigid tubular container 82 can be formed from various types of thermoplastic and thermosetting resins. Preferred examples of the material and oxygen permeability coefficient at 25° C. are similar to the case of the blood collection tube 10 for use in the blood collection container shown in FIG. 1.

On the other hand, the rubber-like elastic tubular container 83 may be formed from a thermoplastic elastomer composition comprised principally of a thermoplastic elastomer, examples of which include diblock, triblock or higher-order block copolymers of styrene-, urethane-, amido-, ester-, vinyl chloride- or olefin-based elastomer; and ethylene-vinyl acetate copolymers. These thermoplastic elastomers may be used alone or in any combination thereof.

In the case where two or more types of thermoplastic elastomers are used in combination, they may be combined in any form. For example, they may be layered or mixed. Also, various additives may be incorporated in the thermoplastic resin composition.

Thermosetting elastomers, such as silicone-based elastomers, may alternatively be used to form the rubber-like elastic tubular container 83.

It is necessary that the rubber-like elastic tubular container 83 be joined, either adhesively or thermally, to the rigid tubular container 82. In such cases, various types of chemical or thermal adhesion modifiers may be applied to an interface therebetween. Preferably, the aforementioned thermoplastic or thermosetting elastomers have intrinsic chemical or thermal adhesion properties. Accordingly, those comprised principally of at least one of urethane-, amido-, ester- and styrene-based thermoplastic elastomers, triblock or higher-order composite copolymers with styrene-based elastomer, either with or without the addition of various additives, are suitably used. The primer-incorporated silicone-based thermosetting elastomer can also be used suitably.

In the manufacture of the blood collection tube 80, the rubber-like elastic tubular container 83 may be inserted in the separately-formed tubular container 82 and then joined together by adhesives or fusion. Conventionally known techniques, such as multiple injection molding, can also be utilized to manufacture the blood collection tube.

Figure 15:
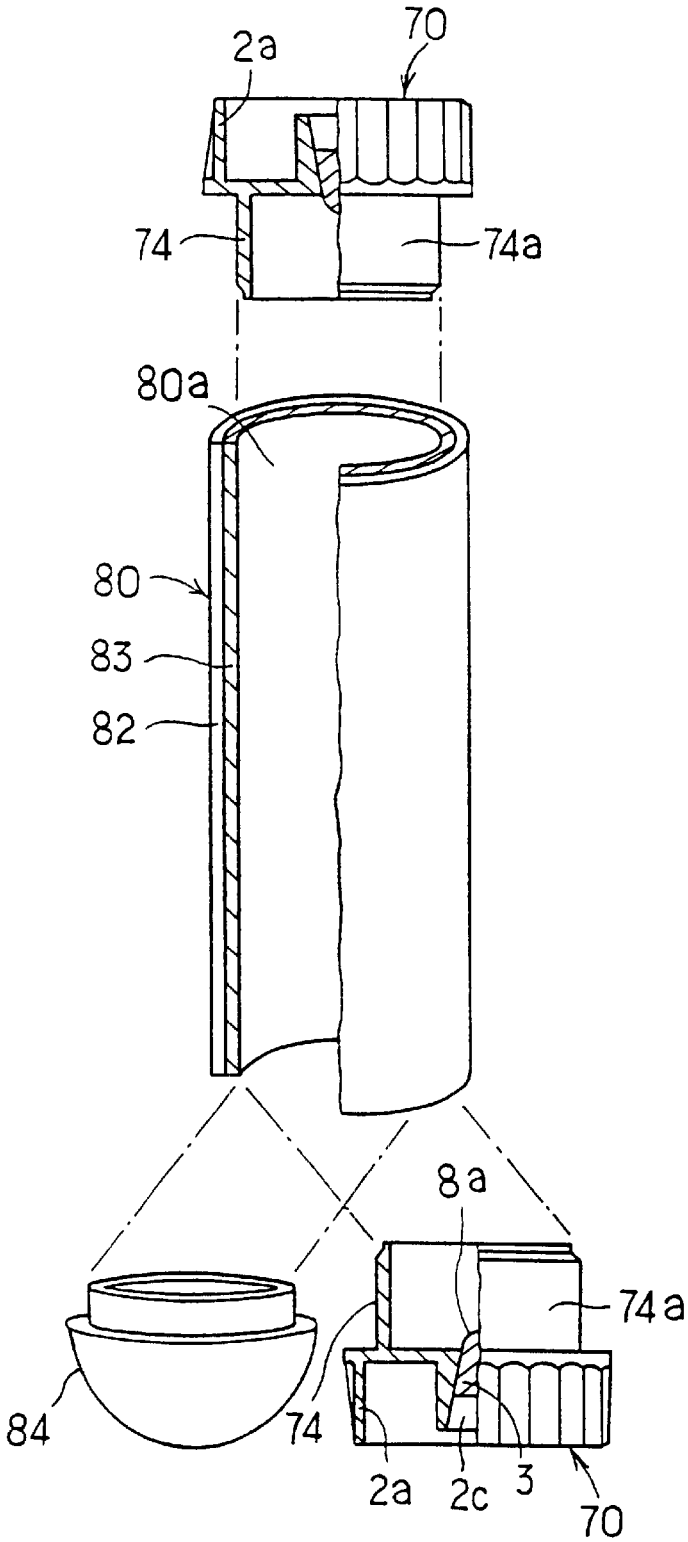
FIG. 15 is an exploded perspective view which explains a further vacuum blood collection container embodiment in accordance with the present invention.

The blood collection tube may be manufactured by a technique which involves coextruding the above-described thermoplastic resin and thermoplastic elastomer into a two-layer pipe, cutting the pipe to a desired length, and fitting a sealing member 84 separately formed from the aforementioned thermoplastic resin into one open end of the two-layer pipe, as shown in FIG. 15. This technique allows the manufacture of the blood collection tube having an optional length.

Instead of using the sealing member 84, the closure structure 70 may be fittingly attached to the two-layer pipe, as shown on a lower right side of FIG. 15, so that a blood collection tube is constructed which allows specimen extraction from both ends.

In the present invention, the preferred thermoplastic elastomer composition includes thermoplastic elastomer having crosslinked rubber elastic domains and contains a compound which form water-insoluble salts or chelates with transition metals.

The metal oxides often used as catalysts for dynamic crosslinking of the aforementioned rubber elastic domains tend to remain in the elastomer by an excess amount even after termination of the crosslinking reaction. When the closure structure formed from such elastomer is contacted with an aqueous specimen, metal ions in the metal oxides may be caused to dissolve into the specimen.

In order to prevent the metal ions from being dissolved into the specimen, such metal ions may be extracted using dilute hydrochloric acid or the like from the elastomer either before or after it is formed into the closure structure. More preferably, the aforementioned compound that forms water-insoluble salts or chelates with transition metals may be incorporated in the elastomer before it is formed into the closure structure, so that the elution of the metal ions can be effectively suppressed.

Examples of compounds that form water-insoluble salts include higher fatty acids containing a hydrophobic residual group and a carboxylic group, such as naphthenic acid, octylic acid, oleic acid, erucic acid, stearic acid and soybean oil fatty acid; and polymeric compounds containing a carboxylic residual group, such as acrylic acid, methacrylic acid, maleic acid and maleic anhydride.

Illustrative of suitable compounds that form water-insoluble chelates are monomeric and polymeric compounds containing a hydrophobic residual group and O,O ligand, O,N ligand, O,S ligand, N,N ligand, N,S ligand or S,S ligand. Examples of such compounds include monomeric compounds such as diethylenetriamine pentaacetic acid, triethylenetetramine hexaacetic acid, 2-mercaptobenzothiazole, N-benzoyl-N-phenylhydroxylamine, N-cinnamoyl-N-phenylhydroxylamine, o-(salicylidene)thiophenol and the like; and polymeric compounds containing a residual group and an amide linkage such as ethylenediamine tetraacetic acid and porphyrin.

These compounds can be mixed with the aforementioned thermoplastic elastomer after they have been solubilized by a solvent, or by a melt kneading technique using an extrusion kneader. These compounds may be fed into a hopper in a forming machine or a Banbury mixer and stirred for mixture with the thermoplastic elastomer prior to being formed.

These compounds that form water-insoluble salts or chelates may be dispersed in particulate form in the thermoplastic elastomer, but preferably dispersed uniformly throughout the elastomer to promote the formation of salts or chelates with remaining transition metals. More preferably, the compounds used have melting points of not above the fabrication temperature of the elastomer.

The thermoplastic elastomer composition in accordance with the present invention may be used to form a whole element of the closure structure for vacuum specimen collection container, but preferably to form the needle cannula penetrating portion having rubber elasticity and the rubber-like elastic fitting portion, as a minimum, whereby the metal ions are prevented from dissolving into the specimen.

EXAMPLES

The present invention will be now described in detail with reference to specific examples.

Figure 12:
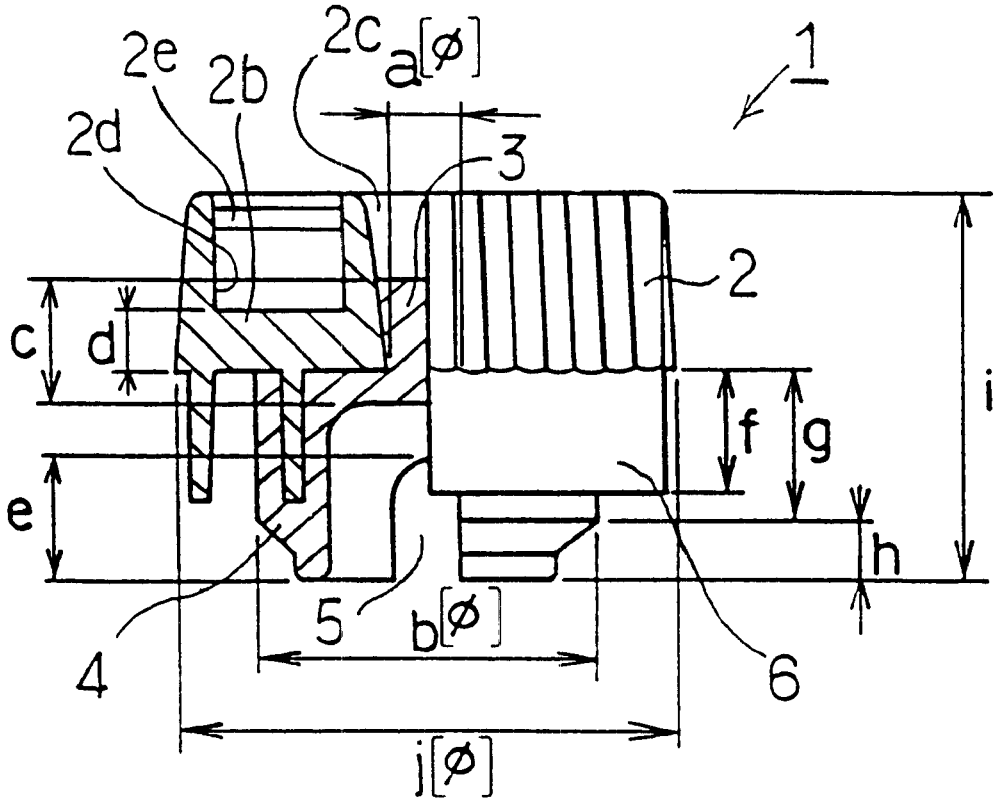
FIG. 12 is a partially cut-away sectional view which indicates a size for each part of the closure structure embodiment in accordance with the present invention.

The following example uses the closure structure embodiment shown in FIG. 9, with the exception that the semi-spherical protuberance 8*a* is excluded from the bottom surface 8 of the needle cannula penetrating portion 3. FIG. 12 is a partially cut-away sectional view which indicates a size for each part of the closure structure shown in FIG. 9. In FIG. 12, a indicates a minimum diameter of the through-hole 2*c*, b indicates an outer diameter of the fitting portion 4, c indicates a thickness of the needle cannula penetrating portion 3, d indicates a thickness of the partition portion 2*b*, e indicates a length of the cutout channel, f indicates a length of the cover 6, g indicates a length of a portion of the fitting portion 4 that has a constant outer diameter, h indicates a length of a tapered portion at the top end of the fitting portion 4, i indicates a whole length of the closure structure 1 and j indicates an outer diameter of a bulk of the closure structure 1.

1. Examples and Comparative Examples Concerning the Ability of the Closure Structure to Maintain Low Pressure

Examples 1–19

(Manufacture of a Vacuum Blood Collection Tube)

The dimension (unit: mm) of each part of the closure structure of FIG. 12, the type and oxygen permeability coefficient (unit: $ml/cm^2 \cdot mm^{-1} \cdot sec \cdot cmHg$) of the material used to form the grip section including the cover and the fitting portion supporting member, the type, Shore hardness A and oxygen permeability coefficient (unit: $ml/cm^2 \cdot mm^{-1} \cdot sec \cdot cmHg$) of the material used to form the needle cannula penetrating portion and fitting portion, for each Examples, are given in Tables 1–3. The type of the adhesion modifier used to provide the improved adhesive surfaces, as well as the type of the lubricant used to reduce friction when the closure structure is attached or detached, are also indicated in Tables 2 and 3. The ratio Sd/So of the minimum cross-sectional area Sd of the needle cannula penetrating portion to the cross-sectional area So at the open end of the blood collection tube, as well as the value calculated from the left side of the relationship (1), are also indicated in Tables 2 and 3.

In the manufacture of each closure structure, the grip section was injection molded, a small amount of adhesive was optionally applied onto its joint surface and then dried, and subsequently the needle cannula penetrating portion and fitting portion were insert molded. Finally, a small amount of lubricant was coated onto a surface of the fitting portion. Also, a kickback preventive annular rib was formed to extend along an inner peripheral surface of the annular side wall in the grip section.

Polyethylene terephthalate was injection molded into a blood collection tube having an inner diameter at its open end of 10.7 mm, a whole length of 100 mm and a volume of 7 ml. Each closure structure was press fitted in the blood collection tube under a reduced pressure to prepare a vacuum blood collection tube purposed to collect 6 ml blood.

(Evaluation)

Commercially available 21G multiple vacuum blood collection needle and needle holder without a kickback preventing mechanism were utilized to suction collect 30° C. water in each of the above-obtained vacuum blood collection tubes according to a conventional vacuum blood collection procedure. During the suction collection, a bottom portion of the blood collection tube was held by a finger tip to prevent a kickback. The actual weight of the collected water was calculated from the difference in weight of the blood collection tube before and after introduction of the water by suction. The measurement in weight of the water suction collected was performed twice, immediately after the manufacture of the vacuum blood collection tube and after it was stored in a 50° C. oven for a week, to evaluate the change in capability of the tube to collect the water by suction with the lapse of time after its manufacture. Also, the resistance of the vacuum blood collection needle was evaluated organoleptically. In addition, the vacuum blood collection tube, after collection of water by suction, was held in a reversed orientation for 30 seconds, during which time possible leakage of water droplets through the needle hole was visually observed, to evaluate the needle hole sealability.

Comparative Example 1

(Manufacture of a Vacuum Blood Collection Tube)

Figure 17:
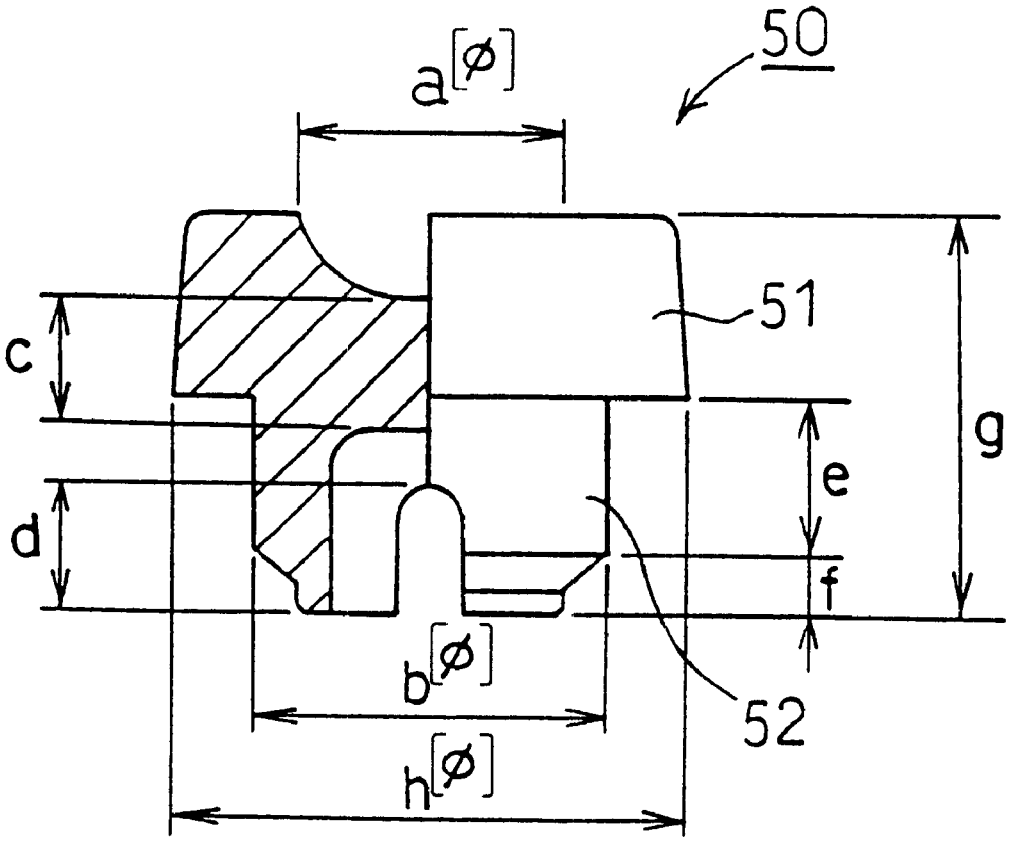
FIG. 17 PRIOR ART
FIG. 17 is a partially cut-away sectional view which indicates a size for each part of a conventional closure structure.

Crosslinked butyl rubber was compression molded into a closure structure having an oxygen permeability coefficient of about $30 \times 10^{-10}$ $ml/cm^2 \cdot mm^{-1} \cdot sec \cdot cmHg$ and measuring the dimension (unit: mm) given in Table 2 for each part shown in FIG. 17, which corresponded to those of rubber closures generally available in the marked. In FIG. 17 the closure 50 comprises a grip section 51 and a fitting portion 52, and the dimensions a–h refer to the parts described in connection with FIG. 12.

(Evaluation)

The closure structure was evaluated in the same manner as in Examples 1–19.

Examples 20–22

(Manufacture of a Vacuum Blood Collection Tube)

Vacuum blood collection tubes each purposed to collect 5 ml blood and having the specification shown in Table 1 were manufactured in the same manner as in Examples 1–19.

(Evaluation)

Each closure structure was evaluated in the same manner as in Examples 1–19.

(Results of Examples 1–22 and Comparative Example 1)

The results obtained for the above Examples are given in Table 5, collectively. The vacuum blood collection tubes obtained in Examples 1–19 provided satisfactory results as comparable to those of the vacuum blood collection tube of Comparative Example 1, in terms of properties such as the capability to maintain a vacuum pressure, resistance to penetration of blood collection needle and needle hole sealability. In contrast, the vacuum blood collection tubes of Examples 20–22 show the reduced capability to maintain a vacuum pressure because of their closure structures which failed to satisfy the relationship (1). However, the vacuum blood collection tubes of Examples 20–22 provided satisfactory results as comparable to those of the vacuum blood collection tube of Comparative Example 1, in terms of resistance to penetration of blood collection needle and needle hole sealability.

TABLE 1

| | Size | | | | | | | | | | Grip Section | |
|---|---|---|---|---|---|---|---|---|---|---|---|---|
| Ex. | a | b | c | d | e | f | g | h | i | j | Material Type (Thermoplastic Resin) | 1)* |
| 1 | 2.4 | 11 | 4 | 2 | 4 | 4 | 5 | 2 | 13 | 17 | Polyethylene Terephthalate | 1 |
| 2 | 2.4 | 11 | 4 | 2 | 4 | 4 | 5 | 2 | 13 | 17 | Nylon | 0.5 |
| 3 | 2.4 | 11 | 4 | 2 | 4 | 4 | 5 | 2 | 13 | 17 | Acrylonitrile-Styrene Copolymer | 4 |
| 4 | 2.8 | 11 | 3 | 1 | 4 | 4 | 5 | 2 | 13 | 17 | Polyethylene Terephthalate | 1 |
| 5 | 4.8 | 11 | 3 | 1 | 4 | 4 | 5 | 2 | 13 | 17 | Polyethylene Terephthalate | 1 |
| 6 | 7.6 | 11 | 3 | 1 | 4 | 4 | 5 | 2 | 13 | 17 | Polyethylene Terephthalate | 1 |
| 7 | 1.9 | 11 | 4 | 1 | 4 | 4 | 5 | 2 | 13 | 17 | Polyethylene Terephthalate | 1 |
| 8 | 1.9 | 11 | 4 | 1 | 4 | 4 | 5 | 2 | 13 | 17 | Polyethylene Terephthalate | 1 |
| 9 | 1.9 | 11 | 4 | 1 | 4 | 4 | 5 | 2 | 13 | 17 | Polyethylene Terephthalate | 1 |
| 10 | 8.5 | 11 | 6 | 2 | 4 | 4 | 5 | 2 | 13 | 17 | Polyethylene Terephthalate | 1 |
| 11 | 8.5 | 11 | 6 | 2 | 4 | 4 | 5 | 2 | 13 | 17 | Polypropylene | 20 |
| 12 | 4.0 | 11 | 3 | 1 | 4 | 4 | 5 | 2 | 13 | 17 | Polyethylene Naphthalate | 0.3 |
| 13 | 4.0 | 11 | 3 | 1 | 4 | 4 | 5 | 2 | 13 | 17 | Polybutylene Terephthalate | 1 |
| 14 | 3.0 | 11 | 7 | 0.5 | 4 | 4 | 5 | 2 | 13 | 17 | Polyethylene Terephthalate | 1 |
| 15 | 6.0 | 11 | 4 | 1 | 4 | 4 | 5 | 2 | 13 | 17 | Polyacrylonitrile | 0.1 |
| 16 | 4.0 | 11 | 6 | 1 | 4 | 4 | 5 | 2 | 13 | 17 | Ethylene-Vinyl Alcohol Copolymer | 0.05 |
| 17 | 4.0 | 11 | 3 | 1 | 4 | 4 | 5 | 2 | 13 | 17 | Polybutylene Terephthalate | 1 |
| 18 | 4.0 | 11 | 3 | 1 | 4 | 4 | 5 | 2 | 13 | 17 | Polybutylene Terephthalate | 1 |
| 19 | 4.0 | 11 | 3 | 1 | 4 | 4 | 5 | 2 | 13 | 17 | Polybutylene Terephthalate | 1 |
| 20 | 1.9 | 11 | 4 | 1 | 4 | 4 | 5 | 2 | 13 | 17 | Polypropylene | 20 |
| 21 | 3.0 | 11 | 4 | 4 | 4 | 4 | 5 | 2 | 13 | 17 | Polypropylene | 20 |
| 22 | 1.9 | 11 | 4 | 1 | 4 | 4 | 5 | 2 | 13 | 17 | Polyethylene Terephthalate | 1 |

1)* Approximate Oxygen Permeability Coefficient:
Unit in $\times 10^{-10}$ ml/cm$^2$ · mm$^{-1}$ · sec · cmHg

TABLE 2

| | Needle Cannula Penetrating Portion/ Fitting Portion | | | | | | |
|---|---|---|---|---|---|---|---|
| Ex. | Material Type (Thermoplastic Elastmer) | 1)* | 2)* | Adhesion Promoter | Applied Lubricant | Sd/So | 3)* |
| 1 | Styrenic (Rabalon, Prod. of Mitsubishi Chemical) | 400 | 60 | Applied, Chemlock481 (Prod. of Rode Far East) | Polydimethyl Siloxane | 0.05 | 5.5 |
| 2 | Styrene-Isobutylene Based (TS Polymer, Prod. of Kuraray) | 30 | 55 | Applied Chemlock481 (Prod. of Rode Far East) | Polypropylene Glycol | 0.05 | 0.6 |
| 3 | Styrene-Crosslinked Isobutylene Based (ITS Polymer, Prod. of Kuraray) | 30 | 60 | Applied Chemlock481 (Prod. of Rode Far East) | Polypropylene Glycol | 0.05 | 2.3 |

TABLE 2-continued

| Ex. | Needle Cannula Penetrating Portion/ Fitting Portion: Material Type (Thermoplastic Elastmer) | 1)* | 2)* | Adhesion Promoter | Applied Lubricant | Sd/So | 3)* |
|---|---|---|---|---|---|---|---|
| 4 | Styrene-Crosslinked Isobutylene Based (ITS Polymer, Adhesion Grade, Prod. of Kuraray) | 30 | 60 | None | Polydimethyl Siloxane | 0.07 | 1.6 |
| 5 | Styrene-Crosslinked Isobutylene Based (ITS Polymer, Adhesion Grade, Prod. of Kuraray) | 30 | 60 | None | Liquid Paraffin | 0.2 | 2.8 |
| 6 | Styrene-Isobutylene Based (TS Polymer, Adhesion Grade, Prod. of Kuraray) | 30 | 60 | None | Polyethylene Glycol | 0.5 | 5.5 |
| 7 | Styrenic (Rabalon, Prod. of Mitsubishi Chemical) | 400 | 60 | Loaded, 5% Hydroxy-Modified Polyolefin | Ethylen Oxide-Propylene Oxide Copolymer | 0.03 | 4.0 |
| 8 | Styrene-Ester Based (Primalloy A, Prod. of Mitsubishi Chemical) | 400 | 60 | None | Alcohol Modified Silicone Oil | 0.03 | 4.0 |
| 9 | Olefin-Crosslinked Isobutylene Based (Trefsin, Prod. of AES Japan) | 50 | 60 | Applied, Chemlock481 (Prod. Of Rode Far East) | Ethylen Oxide-Propylene Oxide Copolymer | 0.03 | 1.3 |
| 10 | Styrene-Isobutylene Based (TS Polymer, Prod. of Kuraray) | 30 | 60 | Loaded, 5% Ethylene-Vinyl Alcohol Copolymer | Liquid Polybutene | 0.63 | 3.3 |
| 11 | Styrene-Crosslinked Isobutylene Based (TS Polymer, Prod. of Kuraray) | 30 | 45 | None | 2-Ethyl Hexyl Phthalate | 0.63 | 6.9 |
| 12 | Styrene-Isobutylene Based (TS Polymer, Adhesion Grade, Prod. of Kuraray) | 30 | 60 | None | Polydimethyl Siloxane | 0.14 | 1.7 |
| 13 | 1) 65% Olefin-Crosslinked Isobutylene Based (Trefsin, Prod. of AES Japan) 2) 30% Styrene-Urethane Based (SU Polymer, Prod. of Kuraray) 3) 5% Styrene-Hydrogenated Isoprene Based (Hybrar, Prod. of Kuraray) | 90 | 50 | None | Polydimethyl Siloxane | 0.14 | 5.1 |

1)* Approximate Oxygen Permeability Coefficient:

TABLE 2-continued

| Ex. | Needle Cannula Penetrating Portion/ Fitting Portion: Material Type (Thermoplastic Elastmer) | 1)* | 2)* | Adhesion Promoter | Applied Lubricant | Sd/So | 3)* |
|---|---|---|---|---|---|---|---|

Unit in × $10^{-10}$ ml/cm$^2$ · mm$^{-1}$ · sec · cmHg
2)* Shore Hardness
3)* Value for Relationship(1):
Unit in × $10^{-10}$ ml/cm$^2$ · mm$^{-1}$ · sec · cmHg

TABLE 3

| Ex. | Needle Cannula Penetrating Portion/ Fitting Portion: Material Type (Thermoplastic Elastmer) | 1)* | 2)* | Adhesion Promoter | Applied Lubricant | Sd/So | 3)* |
|---|---|---|---|---|---|---|---|
| 14 | 1) 50% Styrene-Isobutylene Based (TS Polymer, Prod. of Kuraray) 2) 50% Styrene-Urethane Based (SU Polymer, Prod. of Kuraray) | 90 | 40 | None | Polydimethyl Siloxane | 0.08 | 2.9 |
| 15 | 1) 50% Olefin-Crosslinked Isobutylene Based (Trefsin, Prod. of AES Japan) 2) 45% Styrene-Urethane Based (SU Polymer, Prod. of Kuraray) 3) 5% Styrene-Hydrogenated Isoprene Based (Hybrar, Prod. of Kuraray) | 90 | 50 | None | Polydimethyl Siloxane | 0.31 | 7.0 |
| 16 | Styrenic (Rabalon, Prod. of Mitsubishi Chemical) | 400 | 30 | Applied, Chemlock481 (Prod. of Rode Far East) | Polydimethyl Siloxane | 0.14 | 9.4 |
| 17 | 1) 70% Olefin-Crosslinked Isobutylene Based (Trefsin, Prod. of AES Japan) 2) 30% Styrene-Ester Based (Primalloy A, Prod. of Mitsubishi Chemical) | 90 | 65 | None | Polydimethyl Siloxane | 0.14 | 5.1 |
| 18 | 1) 70% Olefin-Crosslinked Isobutylene Based (Trefsin, Prod. of AES Japan) 2) 30% Styrene-Amide Based (Primalloy E, Prod. of Mitsubishi Chemical) | 90 | 55 | None | Polydimethyl Siloxane | 0.14 | 5.1 |
| 19 | 1) 60% Olefin-Crosslinked | 90 | 60 | None | Polydimethyl Siloxane | 0.14 | 5.1 |

TABLE 3-continued

| Ex. | Needle Cannula Penetrating Portion/ Fitting Portion: Material Type (Thermoplastic Elastmer) | 1)* | 2)* | Adhesion Promoter | Applied Lubricant | Sd/So | 3)* |
|---|---|---|---|---|---|---|---|
| | Isobutylene Based (Trefsin, Prod. of AES Japan) 2) 30% Styrene-Ester Based (Primalloy A, Prod. of Mitsubishi Chemical) 3) 10% Styrene-Urethane Based (SU Polymer, Prod. of Kuraray) | | | | | | |
| 20 | Styrenic (Rabalon, Prod. of Mitsubishi Chemical) | 400 | 30 | None | Polydimethyl Siloxane | 0.03 | 22.4 |
| 21 | Styrenic (Rabalon, Prod. of Mitsubishi Chemical) | 400 | 30 | None | Polydimethyl Siloxane | 0.08 | 12.6 |
| 22 | Thermoplastic Silicone (Primer-incorporated, Prod. of Shinetsu Chemical) | 6000 | 40 | None | Polydimethyl Siloxane | 0.03 | 46.0 |

1)* Approximate Oxygen Permeability Coefficient:
Unit in $\times 10^{-10}$ ml/cm$^2$ · mm$^{-1}$ · sec · cmHg
2)* Shore Hardness
3)* Value for Relationship(1):
Unit in $\times 10^{-10}$ ml/cm$^2$ · mm$^{-1}$ · sec · cmHg

TABLE 4

| | Size | | | | | | | | | | Material | | Applied |
|---|---|---|---|---|---|---|---|---|---|---|---|---|---|
| | a | b | c | d | e | f | g | h | i | j | Type | 1)* | Lubricant |
| Comp. Ex. 1 | 10 | 11 | 5 | 4 | 5 | 2 | 13 | 17 | — | — | Crosslinked Butyl Rubber | 30 | Polydimethyl Siloxane |

1)* Approximate Oxygen Permeability Coefficient:
Unit in $\times 10^{-10}$ ml/cm$^2$ · mm$^{-1}$ · sec · cmHg

TABLE 5

| Ex. | Amount of Absorbed Water (ml): Initially | After one Week | Change (%) | Needle Cannula Pierceability | Needle Hole Sealability |
|---|---|---|---|---|---|
| 1 | 6.1 | 5.9 | 3.3 | Satisfactory | Satisfactory |
| 2 | 6.1 | 5.9 | 3.3 | Satisfactory | Satisfactory |
| 3 | 6.1 | 5.8 | 4.9 | Satisfactory | Satisfactory |
| 4 | 6.1 | 5.8 | 4.9 | Satisfactory | Satisfactory |
| 5 | 6.0 | 5.8 | 3.3 | Satisfactory | Satisfactory |
| 6 | 6.1 | 5.8 | 4.9 | Satisfactory | Satisfactory |
| 7 | 6.1 | 5.9 | 3.3 | Satisfactory | Satisfactory |
| 8 | 6.0 | 5.8 | 3.3 | Satisfactory | Satisfactory |
| 9 | 6.1 | 5.8 | 4.9 | Satisfactory | Satisfactory |

TABLE 5-continued

| | Amount of Absorbed Water (ml): Initially | After one Week | Change (%) | Needle Cannula Pierceability | Needle Hole Sealability |
|---|---|---|---|---|---|
| 10 | 6.0 | 5.8 | 3.3 | Satisfactory | Satisfactory |
| 11 | 6.1 | 5.8 | 4.9 | Satisfactory | Satisfactory |
| 12 | 6.0 | 5.8 | 3.3 | Satisfactory | Satisfactory |
| 13 | 6.0 | 5.7 | 4.9 | Satisfactory | Satisfactory |
| 14 | 6.0 | 5.8 | 3.3 | Satisfactory | Satisfactory |
| 15 | 6.1 | 5.8 | 4.9 | Satisfactory | Satisfactory |
| 16 | 6.1 | 5.6 | 8.0 | Satisfactory | Satisfactory |
| 17 | 6.0 | 5.7 | 4.9 | Satisfactory | Satisfactory |
| 18 | 6.0 | 5.8 | 3.3 | Satisfactory | Satisfactory |
| 19 | 6.0 | 5.7 | 4.9 | Satisfactory | Satisfactory |
| 20 | 6.0 | 5.1 | 15.0 | Satisfactory | Satisfactory |

TABLE 5-continued

| | Amount of Absorbed Water (ml) | | | | |
|---|---|---|---|---|---|
| | Initially | After one Week | Change (%) | Needle Cannula Pierceability | Needle Hole Sealability |
| 21 | 6.1 | 5.4 | 11.0 | Satisfactory | Satisfactory |
| 22 | 6.1 | 4.1 | 33.0 | Satisfactory | Satisfactory |
| Comp. Ex. 1 | 6.0 | 5.8 | 3.3 | Satisfactory | Satisfactory |

2. Examples and Comparative Examples Concerning the Improved Needle Hole Sealability of the Closure Structure The other embodiments of the present invention will be now described in detail with reference to the following specific examples. The following examples utilize the closure structure embodiment shown in FIG. 9. Since the sizes of the closure structure parts, other than the semi-spherical protuberance 8*a* provided on the needle cannula penetrating portion so as to face toward the blood collection tube, are indicated by the small letters in the same manner as in FIG. 12, the explanation thereof is omitted here.

Examples 23

(Manufacture of Vacuum Blood Collection Tube)

The values for the sizes of closure structure parts as indicated by the small characters shown in FIG. 12, their material characteristics and the like are given in Tables 6 and 7. An outer diameter of the semi-spherical protuberance 8*a* corresponds to the dimension as indicated by the letter a in FIG. 12. Twenty vacuum blood collection tubes, each purposed to collect 6 ml blood, were manufactured using the closure structure of this Example in the same manner as in Examples 1–19.

(Evaluation)

Each vacuum blood collection tube was caused to suction collect 30° C. water in the same manner as in Example 1. In order to evaluate its needle hole sealability under severer conditions than in Examples 1–19, the vacuum blood collection tube was then completely immersed in a constant temperature water vessel maintained at 40° C. so as to reside in an upright position for 20 seconds, during which time the possible leakage of air bubbles through the needle hole was visually observed.

Comparative Example 2

(Manufacture of Vacuum Blood Collection Tube)

Twenty vacuum blood collection tubes, each identical in construction to that of Comparative Example 1 and purposed to collect 6 ml blood, were manufactured.

(Evaluation)

The possible leakage of air bubbles through the needle hole was visually observed in the same manner as in Example 23.

Comparative Example 3

(Manufacture of Vacuum Blood Collection Tube)

The product specification of Example 23 was followed, except that the semi-spherical protuberance 8*a* was excluded, to manufacture twenty vacuum blood collection tubes, each purposed to collect 6 ml blood.

(Evaluation)

The possible leakage of air bubbles through the needle hole was visually observed in the same manner as in Example 23.

(Results of Example 23 and Comparative Examples 2, 3)

The results are shown in Tables 6 and 7. In Example 23, the proportion of vacuum blood collection tubes that showed air bubble leakage was determined as being 1/20, as comparable to that determined for Comparative Example 2. In contrast, the proportion of vacuum blood collection tubes in Comparative Example 3 that showed air bubble leakage was determined as being 12/20, although observed under severe conditions. This demonstrate their insufficient needle hole sealability.

TABLE 6

| | Size | | | | | | | | | | Grip Section | |
|---|---|---|---|---|---|---|---|---|---|---|---|---|
| | a | b | c | d | e | f | g | h | i | j | Material Type (Thermoplastic Resin) | 1)* |
| Ex. 23 | 7.6 | 11 | 3 | 1 | 4 | 4 | 5 | 2 | 13 | 17 | Polyethylene Terephthalate | 1 |
| Comp. EX. | | | | | | | | | | | | |
| 2 | Identical to Those of Comp. Ex. 1 | | | | | | | | | | | |
| 3 | 7.6 | 11 | 3 | 1 | 4 | 4 | 5 | 2 | 13 | 17 | Polyethylene Terephthalate | 1 |

1)* Approximate Oxygen Permeability Coefficient:

Unit in $\times 10^{-10}$ ml/cm$^2$ · mm$^{-1}$ · sec · cmHg

TABLE 7

| | Needle Cannula Penetrating Portion/ Fitting Portion | | | | | | |
|---|---|---|---|---|---|---|---|
| | Material Type (Thermoplastic Elastmer) | 1)* | 2)* | Adhesion Promoter | Applied Lubricant | 3)* | 4)* |
| Ex. 23 | Styrene-Isobutylene Based (TS Polymer Adhesion Grade, Prod. of Kuraray) | 30 | 60 | None | Polyethylene Glycol | Present | 1/20 |
| Comp. Ex. | | | | | | | |
| 2 | Identical to Those of Comp. Ex. 1 | | | | | | 0/20 |
| 3 | Styrene-Isobutylene Based (TS Polymer Adhesion Grade, Prod. of Kuraray) | 30 | 60 | None | Polyethylene Glycol | Absent | 12/20 |

1)* Approximate Oxygen Permeability Coefficient:
Unit in $\times 10^{-10}$ ml/cm$^2$ · mm$^{-1}$ · sec · cmHg
2)* Shore Hardness
3)* Semi-Spherical Protuberance
4)* Frequency of Air Bubble Leakage

3. Examples/Comparative Examples Concerning the Vacuum Blood Collection Device Holder

Example 24

(Manufacture of a Vacuum Blood Collection Device Holder)

Figure 16A:
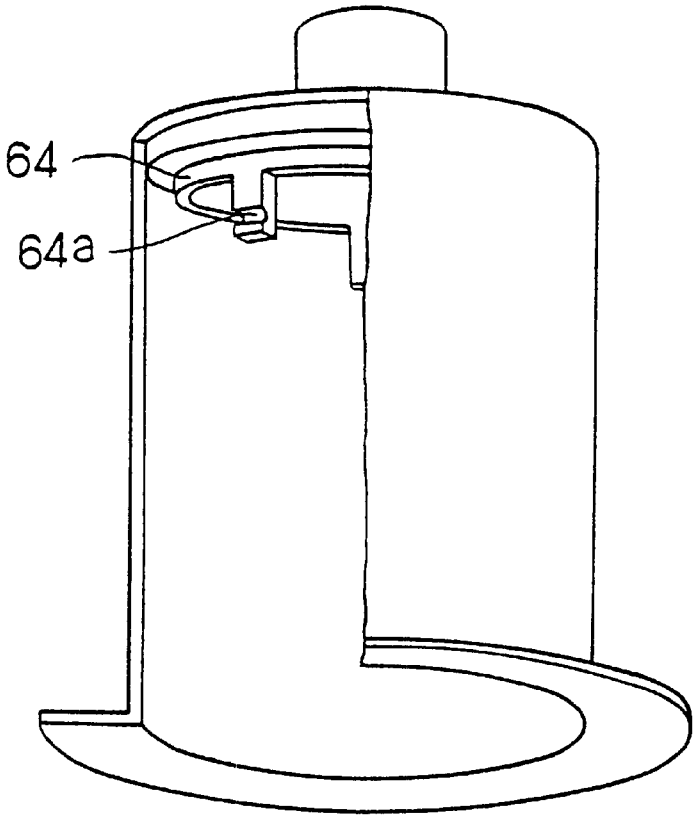
FIG. 16(*a*) is a partially cut-away perspective view which explains a further vacuum blood collection device holder embodiment in accordance with the present invention and 16(*b*) is a perspective view showing an elastic member incorporated in the holder.
Figure 16B:
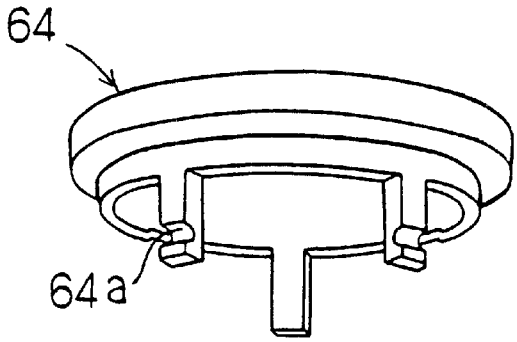
Figure 18A:
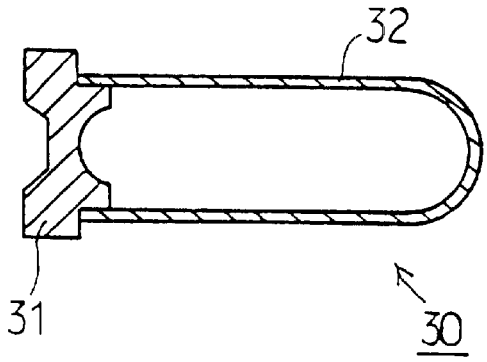
FIG. 18(a) PRIOR ART
FIG. 18 is a view showing a basic construction of a conventional blood collection system.
Figure 18B:
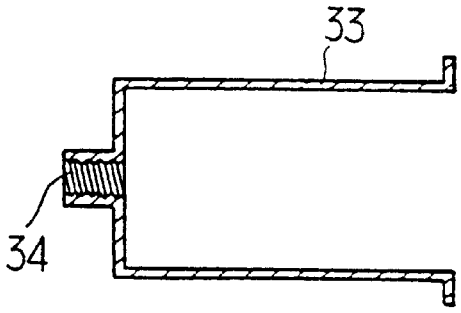
FIG. 18(b) PRIOR ART
Figure 18C:
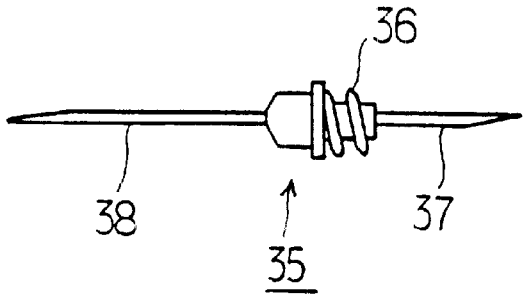
FIG. 18(c) PRIOR ART
Figure 19:
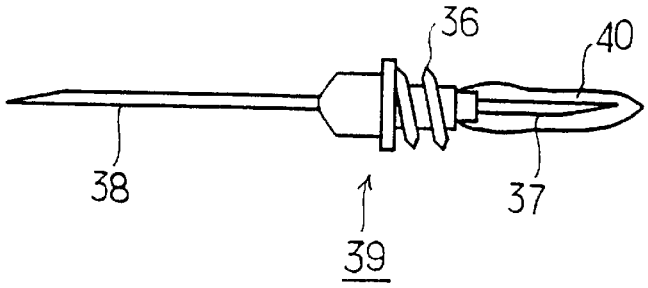
FIG. 19 PRIOR ART
FIG. 19 is a side view showing a multiple blood collection needle.
Figure 20:
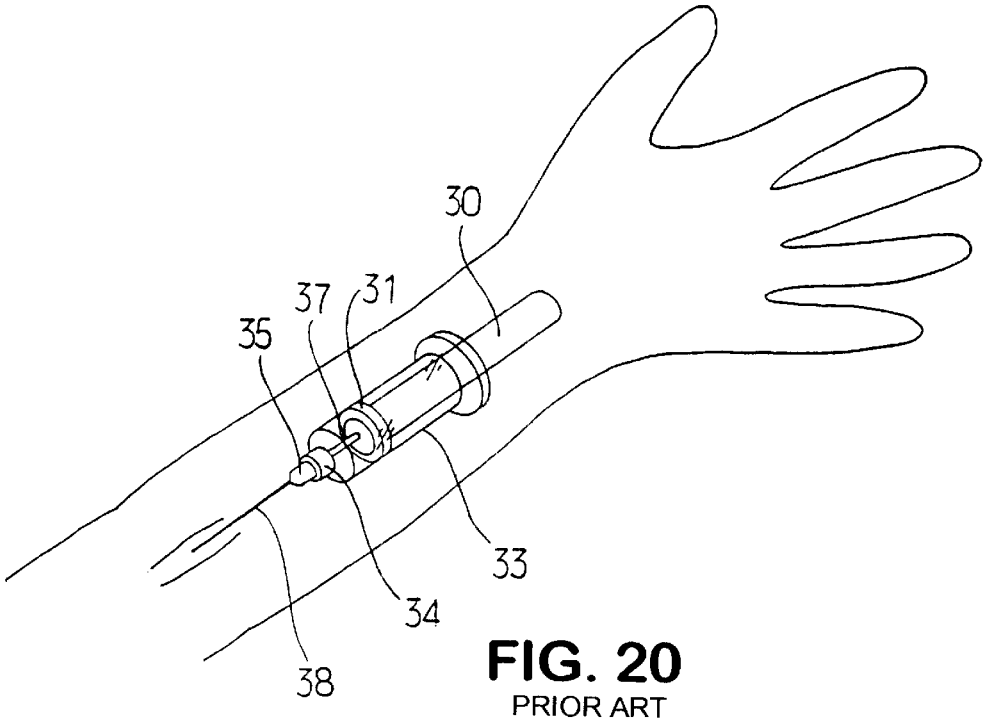
FIG. 20 PRIOR ART
FIG. 20 is a perspective view showing a vacuum blood collection system while in use for blood collection.

Polyoxymethylene was injection molded to form a spring-like elastic member 64, such as shown in FIG. 13(*a*), as a separate member which can be built in a main body of the holder for vacuum blood collection devices, as illustrated in FIG. 16(*b*). This elastic member was fittingly placed in a position deep inside a generally marketed polypropylene vacuum blood collection device holder as illustrated in FIG 18(*b*). FIG. 16(*a*) is a partially cut-away sectional view of the resulting vacuum blood collection device holder.

(Evaluation)

A vacuum blood collection tube similar in construction to that of Example 1 and a 21G multiple blood collection needle were fittingly coupled to the holder of this Example. Then, suction was applied to collect 30° C. water in the tube, as similar to Examples 1–19, to visually observe the kick-back preventive performance during the suction.

(Results)

The insertion of the vacuum blood collection tube deep inside the holder resulted in the elastic engagement of the kickback preventive annular rib disposed in the grip section of the closure structure with the groove on the kickback preventive elastic member disposed deep inside the holder. This engagement was sufficient to withstand a counterforce accompanying compression of the elastic sheath of the multiple blood collection needle, so that the vacuum blood collection tube was allowed to be kept retained within the holder 60 in a satisfactory fashion. After the suction was terminated, a sufficient pulling force was applied to the blood collection tube. Then, the annular rib failed to resist the force to disengage from the groove 64*a,* resulting in the successful separation of the blood collection tube from the holder.

Comparative Example 4

(Manufacture of a Vacuum Blood Collection Device Holder)

A generally marketed polypropylene, vacuum blood collection device holder that excluded a kickback preventive member, as shown in FIG. 18(*b*), was used without any modification.

(Evaluation)

Evaluation was performed in the same manner as in Example 24.

(Results)

As the vacuum blood collection tube of the present invention was brought deeper inside the holder, the counterforce of the rubber sheath of the multiple blood collection needle increased. The associated increase of the kickback force made it difficult to continue collecting water by suction without the assistance of a finger tip to apply a force toward a bottom of the blood collection tube.

4. Examples/Comparative Examples Relating to the Compounding Material which Suppress the Elution of Metal Ions from Thermoplastic Elastomer Containing Transition Metal Oxide as a Catalyst for Dynamic Crosslinking

Examples 25 and 26

(Preparation of Pellet-Form Compounding Material)

The compounding additives used are specified in Table 8. In Example 25, ethylene-methacrylate copolymer (NUCREL, manufactured by Mitsui-Du Pont Polychemical Co., Ltd.) was used as an additive for formation of insoluble metal salts. In Example 26, styrene/amide thermoplastic elastomer (PRIMALLOY E, manufactured by Mitsubishi Chemical Co., Ltd.) was used as an additive for formation of insoluble metal chelates. The dynamic crosslinking catalyst used for olefin/crosslinked isobutylene thermoplastic elastomer (TREFSIN, manufactured by AES Japan Ltd.) was zinc oxide. The compounding additives were roughly mixed by stirring and then melt kneaded by using an extruder. The extruded strands were subsequently cooled in water. Finally, a compounding material was obtained in the pellet form.

(Evaluation)

The pellet-form compounding material was immersed in ten-fold weight of ion-exchanged water and maintained at 40° C. for 24 hours. Thereafter, a concentration of zinc in the ion-exchanged water was determined by atomic absorption spectroscopy.

Comparative Example 5

(Preparation of Pellet-Form Compounding Material)

The pellet-form olefin/crosslinked isobutylene thermoplastic elastomer (TREFSIN, manufactured by AES Japan Ltd.) was used.

(Evaluation)

Evaluation was performed in the same manner as in Examples 25 and 26.

(Results of Examples 25, 26 and Comparative Example 5)

The zinc concentration determined for each Example was divided by the loading proportion of the olefin/crosslinked isobutylene thermoplastic elastomer (TREFSIN, manufactured by AES Japan Ltd.) and further divided by the concentration of zinc determined for Comparative Example 5 to give a relative value when the concentration of eluted zinc in Comparative Example 5 was taken as 1.0. The results are given in Table 9. The concentration of eluted zinc determined for each Example was reduced to about a quarter of that for Comparative Example 5, demonstrating the improved effect.

TABLE 8

| | Formulation Ingredients | |
|---|---|---|
| Ex.25 | 1) | 57% Olefine-Crosslinked Isobutylene Based (Trefsin, Prod. of AES Japan) |
| | 2) | 35% Styrene-Ester Based (Primalloy A, Prod. of Mutsubishi Chemical) |
| | 3) | 5% Styrene-Urethane Based (SU Polymer, Prod. of Kuraray) |
| | 4) | 3% Ethylene-Methacryic Acid Copolymer (Nucrel, Prod. of Mitsui-Dupont Polychemical) |
| Ex.26 | 1) | 70% Olefine-Crosslinked Isobutylene Based (Trefsin, Prod. of AES Japan) |
| | 2) | 30% Styrene-Amide Based (Primalloy E, Prod. of Mitsubishi Chemical) |

TABLE 9

| | Conc. of Eluted Zinc |
|---|---|
| Ex.25 | 0.22 |
| Ex.26 | 0.25 |
| Comp.Ex.5 | 1.00 |

Utility in Industry

The closure structure for a vacuum specimen collection container according to the first invention is constructed to include the grip section, the rubber elastic needle cannula penetrating portion and the rubber-like elastic fitting portion, and the reduction in structural complexity leads to its high productivity. Also, at least one recessed or raised portion for a kickback preventive purpose is provided on an inner side of the tubular side wall portion in the grip section. If a raised or recessed portion engageable with the aforementioned recessed or raised portion is provided deep inside a needle cannula retaining portion of the vacuum specimen collection device holder, the occurrence of a kickback phenomenon which may be caused, for example, by an elastic sheath of a multiple blood collection needle, is prevented effectively.

Also, the rubber-like elastic fitting portion is configured to be fittingly received in an airtight fashion by an inner surface of an open end of a specimen collection tube, thereby assuring the effective maintenance of a vacuum condition within the vacuum specimen collection container.

The ability of the needle cannula penetrating portion to permit easy penetration of a needle cannula and reseal a needle hole left after it is retracted is also contributive to maintaining a sealed condition of the vacuum specimen collection container.

In the embodiment where the closure structure for a vacuum specimen collection container according to the first invention further includes a fitting portion supporting member embedded in the fitting portion, the integrity of the fitting portion within the closure structure is increased to thereby prevent excessive deformation of the elastic fitting portion that may be caused when the closure structure is attached or detached.

In addition, the reduction in needle hole sealability as a result of the provision of the fitting portion supporting member can be suppressed by the provision of the protuberance on a bottom surface of the needle cannula penetrating portion. That is, the provision of protuberance on the bottom surface of the needle cannula penetrating portion enhances the needle hole sealability in the manner as described earlier.

The closure structure for a vacuum specimen collection container according to the second invention is constructed to include the grip section, the rubber elastic needle cannula penetrating portion and the rubber-like elastic fitting portion, as similar to the first invention, and the reduction in structural complexity leads to its high productivity. Also, the provision of the protuberance on the bottom surface of the needle cannula penetrating portion increases the needle hole sealability to thereby effectively maintain a sealed condition of the vacuum specimen collection container.

In the vacuum specimen collection container closure structure according to the present invention, if the through-hole is configured to increase its diameter in an upward direction from the needle cannula penetrating portion, the introduction such as of a vacuum blood collection needle or a sampling nozzle for specimen extraction into the through-hole can be facilitated. This accordingly leads to the easy introduction of their tips into the vacuum specimen collection container.

If a wall thickness T1 (mm) of the partition portion of the grip section, an oxygen permeability coefficient P1 (ml/$cm^2 \cdot mm^{-1} \cdot sec \cdot cmHg$) of the partition portion at 25° C., a wall thickness T2 (mm) of the needle cannula penetrating portion in a needle penetrating direction, an oxygen permeability coefficient P2 ($ml/cm^2 \cdot mm^{-1} \cdot sec \cdot cmHg$) of the needle cannula penetrating portion at 25° C., a minimum cross-sectional area Sd ($cm^2$) of the through-hole in the grip section and an open area So ($cm^2$) at the open end of the specimen collection tube are selected to satisfy the relationship (1), the gas barrier property of the closure structure is enhanced to a sufficient level to effectively maintain a vacuum condition within the vacuum specimen collection container.

The vacuum specimen collection container closure structure according to the present invention, if its grip section is formed from the above-specified thermoplastic resin composition and its needle cannula penetrating portion and fitting portion are formed from the above-specified respective thermoplastic elastomer compositions and Sd/So does not exceed 0.7, can effectively maintain a vacuum condition within the vacuum specimen collection container because of its excellent gas barrier property. Also, the use of the thermoplastic resin and elastomer compositions allows easy manufacture of the closure structure such as by injection molding, thereby increasing productivity of the closure structure for a vacuum specimen collection container.

If the grip section is comprised principally of at lease one selected from the group consisting of polyester, polyamide, polyallylate, polyacetal and ethylene-vinyl alcohol copolymer, and the needle penetrating portion and the fitting portion are comprised of thermoplastic elastomer that can be chemically or thermally adhered to the grip section, the closure structure can effectively maintain a vacuum condition within the vacuum specimen collection container as a result of its excellent gas barrier property. In addition, the easy connection of the needle cannula penetrating portion and fitting portion to the grip section by chemical or thermal adhesion increases productivity of the closure structure for a vacuum specimen collection container.

A vacuum specimen collection container according to the present invention includes the closure structure of the present invention and a vacuum specimen collection tube. Due to the incorporation of the closure structure excellent in productivity and gas barrier property, the vacuum specimen collection container has the capability to surely maintain its interior pressure if reduced to vacuum.

In the case where a vacuum specimen collection container according to the present invention includes a closure structure according to the second invention and a vacuum specimen collection tube having a rubber-like elastic, closure structure receiving portion at an inner face of its opening, the provision of the rubber-like elastic, closure structure receiving portion in the vacuum specimen collection tube facilitates insertion of the closure structure into the vacuum specimen collection tube and permits the closure structure fitting portion to come into close contact with the inner face at the opening of the vacuum specimen collection tube.

A vacuum specimen collection system according to the present invention includes a closure structure for a vacuum specimen collection container according to the present invention, a vacuum specimen collection tube, a vacuum specimen collection device holder and a vacuum specimen collection needle. Also, an elastic member having a raised or recessed portion engageable with the recessed or raised portion on an inner side of the tubular side wall portion in the grip section of the closure structure is provided deep inside a needle cannula retaining portion of the vacuum specimen collection device holder. This effectively prevents the occurrence of the above-described kickback phenomenon which may be caused when a multiple vacuum specimen collection needle is used, as well as leading to the construction of the vacuum specimen collection system excellent in productivity and gas barrier property.

A vacuum specimen collection device holder according to the present invention is the holder for use in combination with a closure structure according to the present invention. Since it incorporates an elastic member having a raised or recessed portion engageable with the recessed or raised portion on an inner side of the tubular side wall portion in the grip section of the closure structure, the occurrence of the above-described kickback phenomenon that may be caused when used in combination with a multiple vacuum specimen collection needle can be effectively prevented.

A thermoplastic elastomer composition according to the present invention is utilized to form at least a needle cannula penetrating portion and a rubber-like elastic fitting portion of a closure structure for a vacuum blood collection container according to the present invention. In such a case, a transition metal is caused to form a water-insoluble salt or chelate so that its ionic form dissolution into the specimen is effectively prevented.

What is claimed is:

1. A closure structure for a vacuum specimen collection container which can be detachably fitted in an open end of a specimen collection tube in an airtight manner to maintain a vacuum condition inside the specimen collection tube, the closure structure comprising:

a grip section including a tubular side wall portion for providing a finger grip, a partition portion extending inward from the side wall portion and having a through-hole through which a specimen collection needle cannula can be passed into the specimen collection tube;

a rubber elastic, needle cannula penetrating portion provided to fill up the through-hole in the grip section and having the capability to reseal a hole if left after the needle cannula is retracted;

a rubber elastic fitting portion depending from the needle cannula penetrating portion or the grip section and configured to follow an inner surface profile at the open end of the specimen collection tube to thereby contact fit therein in an airtight manner;

said grip section having a higher rigidity relative to the needle cannula penetrating portion and the fitting portion; and said tubular side wall of the grip section being provided on its inner side with at least one raised or recessed portion to prevent kickback;

wherein below-specified parameters satisfy the following relationship (1):

$$\frac{(So - Sd) \times P1}{T1} + \frac{Sd \times P2}{T2} \leqq 10 \times 10^{-10}$$

where T1 (mm) is a wall thickness of the partition portion of the grip section, P1 ($ml/cm^2 \cdot mm^{-1} \cdot sec \cdot cm$ Hg) is an oxygen permeability coefficient of the partition at 25° C., T2 (mm) is a wall thickness of the needle cannula penetrating portion in a needle penetrating direction, P2 ($ml/cm^2 \cdot mm^{-1} \cdot sec \cdot cmHg$) is an oxygen permeability coefficient of the needle cannula penetrating portion at 25° C., Sd ($cm^2$) is a minimum cross-sectional area of the through-hole in the grip section and So ($cm^2$) is an open area at the open end of the specimen collection tube.

2. The closure structure for a vacuum specimen collection container as recited in claim 1, characterized as further comprising a fitting portion supporting member extending from the partition portion toward the fitting portion and embedded in the fitting portion, and a protuberance provided on a bottom surface of the needle cannula penetrating portion that is located above a lower end of the fitting portion supporting member.

3. The closure structure for a vacuum specimen collection container of claim 2, wherein said through-hole is configured to increase its diameter in an upward direction from the needle cannula penetrating portion.

4. The closure structure for a vacuum specimen collection container of claim 2, wherein the grip section is comprised principally of at least one selected from the group consisting of polyester, polyamide, polyallylate, polyacetal and ethylene-vinyl alcohol polymer, and wherein the needle penetrating portion and the fitting portion are comprised of thermoplastic elastomer that can be chemically or thermally adhered to the grip section.

5. A vacuum specimen collection container including the closure structure of claim 2, and a vacuum specimen collection tube.

6. A vacuum specimen collection system comprising:

the closure structure for a vacuum specimen collection container of claim 2;

a vacuum specimen collection tube;

a tubular holder having an opening at its one end for receiving the vacuum specimen collection tube and a means at its other end for retaining a specimen collection needle cannula;

a vacuum specimen collection needle; and an elastic member provided deep inside the holder on the needle cannula retaining side and having a recessed or raised portion which is engageable with the raised or recessed portion provided on the inner side of the tubular side wall in the grip section of the closure structure.

7. A holder for use in combination with the closure structure for a vacuum specimen collection container of claim 2, wherein said holder is tubularly configured to have an opening at its one end for receiving a vacuum specimen collection tube and a means at its other end for retaining a specimen collection needle cannula, and that said holder is provided deep inside thereof on the needle cannula retaining side with a recessed or raised portion engageable with the raised or recessed portion on the inner side of the tubular side wall in the grip section of the closure structure.

8. A thermoplastic elastomer composition for use in the formation of at least the needle cannula penetrating portion and/or the rubber elastic fitting portion of the closure structure of claim 2, said composition containing thermoplastic elastomer having rubber elastic domains produced via dynamic crosslinking under a catalyzing action of transition metal oxide, and a compound capable of forming a water-insoluble salt or chelate with said transition metal.

9. The closure structure for a vacuum specimen collection container of claim 1, wherein said through-hole is configured to increase its diameter in an upward direction from the needle cannula penetrating portion.

10. The closure structure for a vacuum specimen collection container of claim 1, wherein the grip section comprises a thermoplastic resin composition having an oxygen permeability coefficient at 25° C., P1, of not exceeding $30\times10^{-10}$ $ml/cm^2*mm^{-1}*sec*cm$ Hg, the needle cannula penetrating portion comprises a thermoplastic elastomer composition having an oxygen permeability coefficient at 25° C., P2, of not exceeding $700\times10^{-10}$ $ml/cm^2*mm^{-1}*sec*cm$ Hg and the fitting portion comprises a thermoplastic elastomer composition having an oxygen permeability coefficient at 25° C., P2, of not exceeding $10{,}000\times10^{-10}$ $ml/cm^2*mm^{-1}*sec*cm$ Hg; and wherein a ratio of a minimum cross-sectional area Sd of the through-hole in the grip section to an open area So at the open end of the specimen collection tube, Sd/So, does not exceed 0.7.

11. The closure structure for a vacuum specimen collection container of claim 1, wherein the grip section is comprised principally of at least one selected from the group consisting of polyester, polyamide, polyallylate, polyacetal and ethylene-vinyl alcohol polymer, and wherein the needle penetrating portion and the fitting portion are comprised of thermoplastic elastomer that can be chemically or thermally adhered to the grip section.

12. A vacuum specimen collection container including the closure structure of claim 1, and a vacuum specimen collection tube.

13. A vacuum specimen collection system comprising:

the closure structure for a vacuum specimen collection container of claim 1;

a vacuum specimen collection tube;

a tubular holder having an opening at its one end for receiving the vacuum specimen collection tube and a means at its other end for retaining a specimen collection needle cannula;

a vacuum specimen collection needle; and an elastic member provided deep inside the holder on the needle cannula retaining side and having a recessed or raised portion which is engageable with the raised or recessed portion provided on the inner side of the tubular side wall in the grip section of the closure structure.

14. A holder for use in combination with the closure structure for a vacuum specimen collection container of claim 1, wherein said holder is tubularly configured to have an opening at its one end for receiving a vacuum specimen collection tube and a means at its other end for retaining a specimen collection needle cannula, and that said holder is provided deep inside thereof on the needle cannula retaining side with a recessed or raised portion engageable with the raised or recessed portion on the inner side of the tubular side wall in the grip section of the closure structure.

15. A thermoplastic elastomer composition for use in the formation of at least the needle cannula penetrating portion and/or the rubber elastic fitting portion of the closure structure of claim 1, said composition containing thermoplastic elastomer having rubber elastic domains produced via dynamic crosslinking under a catalyzing action of transition metal oxide, and a compound capable of forming a water-insoluble salt or chelate with said transition metal.

16. A closure structure for a vacuum specimen collection container which can be detachably fitted in an open end of a specimen collection tube in an airtight manner to maintain a vacuum condition inside the specimen collection tube, the closure structure comprising:

a grip section including a tubular side wall portion for providing a finger grip, a partition portion extending inward from the side wall portion and having a through-hole through which a specimen collection needle cannula can be passed into the specimen collection tube;

a rubber elastic, needle cannula penetrating portion provided to fill up the through-hole in the grip section and having the capability to reseal a hole if left after the needle cannula is retracted;

a rubber elastic fitting portion depending from the needle cannula penetrating portion of the grip section and configured to follow an inner surface profile at the open end of the specimen collection tube to thereby contact fit therein in an airtight manner; and said needle cannula penetrating portion being provided on its bottom surface with a protuberance in the form of either a semi-sphere, a cylinder, or a truncated conical shape;

wherein below-specified parameters satisfy the following relationship (1):

$$\frac{(So - Sd) \times P1}{T1} + \frac{Sd \times P2}{T2} \leqq 10 \times 10^{-10}$$

where T1 (mm) is a wall thickness of the partition portion of the grip section, P1 (ml/cm$^2$·mm$^{-1}$·sec·cm Hg)is an oxygen permeability coefficient of the partition at 25° C., T2 (mm) is a wall thickness of the needle cannula penetrating portion in a needle penetrating direction, P2 (ml/cm$^2$·mm$^{-1}$·sec·cmHg)is an oxygen permeability coefficient of the needle cannula penetrating portion at 25° C., Sd (cm$^2$) is a minimum cross-sectional area of the through-hole in the grip section and So (cm$^2$) is an open area at the open end of the specimen collection tube.

17. A vacuum specimen collection container including the closure structure recited in claim 16, and a vacuum specimen collection tube having a rubber elastic, closure structure receiving portion at an interface of its open end.

18. The closure structure for a vacuum specimen collection container of claim 16, wherein said through-hole is configured to increase its diameter in an upward direction from the needle cannula penetrating portion.

19. The closure structure for a vacuum specimen collection container of claim 16, wherein the grip section is comprised principally of at least one selected from the group consisting of polyester, polyamide, polyallylate, polyacetal and ethylene-vinyl alcohol polymer, and wherein the needle penetrating portion and the fitting portion are comprised of thermoplastic elastomer that can be chemically or thermally adhered to the grip section.

20. A vacuum specimen collection container including the closure structure of claim 16, and a vacuum specimen collection tube.

21. A vacuum specimen collection system comprising:

the closure structure for a vacuum specimen collection container of claim 16;

a vacuum specimen collection tube;

a tubular holder having an opening at its one end for receiving the vacuum specimen collection tube and a means at its other end for retaining a specimen collection needle cannula;

a vacuum specimen collection needle; and an elastic member provided deep inside the holder on the needle cannula retaining side and having a recessed or raised portion which is engageable with the raised or recessed portion provided on the inner side of the tubular side wall in the grip section of the closure structure.

22. A holder for use in combination with the closure structure for a vacuum specimen collection container of claim 16, wherein said holder is tubularly configured to have an opening at its one end for receiving a vacuum specimen collection tube and a means at its other end for retaining a specimen collection needle cannula, and that said holder is provided deep inside thereof on the needle cannula retaining side with a recessed or raised portion engageable with the raised or recessed portion on the inner side of the tubular side wall in the grip section of the closure structure.

23. A thermoplastic elastomer composition for use in the formation of at least the needle cannula penetrating portion and/or the rubber elastic fitting portion of the closure structure of claim 16, said composition containing thermoplastic elastomer having rubber elastic domains produced via dynamic crosslinking under a catalyzing action of transition metal oxide, and a compound capable of forming a water-insoluble salt or chelate with said transition metal.

* * * * *